US009844958B2

(12) United States Patent
Kako et al.

(10) Patent No.: US 9,844,958 B2
(45) **Date of Patent: *Dec. 19, 2017**

(54) PRINTER, AND METHOD AND COMPUTER-READABLE MEDIUM FOR THE SAME

(71) Applicant: Brother Kogyo Kabushiki Kaisha, Nagoya-shi, Aichi-ken (JP)

(72) Inventors: Keigo Kako, Nagoya (JP); Tomoki Miyashita, Nagoya (JP); Junya Kawai, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/279,824

(22) Filed: Sep. 29, 2016

(65) Prior Publication Data

US 2017/0182804 A1 Jun. 29, 2017

(30) Foreign Application Priority Data

Dec. 24, 2015 (JP) ..... 2015-251133

(51) Int. Cl.
*B41J 11/42* (2006.01)
*B41J 13/00* (2006.01)
(Continued)

(52) U.S. Cl.
CPC ..... *B41J 13/0009* (2013.01); *B41J 3/4075* (2013.01); *B41J 11/42* (2013.01);
(Continued)

(58) Field of Classification Search
CPC ..... B41J 13/0009; B41J 11/42; B41J 11/70; B41J 2/32
See application file for complete search history.

(56) References Cited

U.S. PATENT DOCUMENTS

2013/0050384 A1* 2/2013 Sugimoto ..... B41J 3/4075 347/218
2017/0182805 A1* 6/2017 Kawai ..... B41J 13/0009

FOREIGN PATENT DOCUMENTS

JP H09-76603 A 3/1997
JP 2007-038557 A 2/2007

* cited by examiner

*Primary Examiner* — Manish S Shah
*Assistant Examiner* — Yaovi M Ameh
(74) *Attorney, Agent, or Firm* — Banner & Witcoff, Ltd.

(57) ABSTRACT

A printer includes a controller configured to execute a printed matter producing process including printing page images on a medium in a first position on a conveyance path while conveying the medium along the conveyance path, storing a cut target position for each page image and cutting the medium in a second position downstream of the first position in a conveyance direction when the cut target position reaches the second position, an interrupting process including interrupting the printed matter producing process and storing an uncut position as a cut target position located between the first and second positions when the printed matter producing process is interrupted, when an error occurs during the printed matter producing process, and a resuming process including resuming the printed matter producing process when the error is settled during the interruption of the printed matter producing process, and cutting the medium based on the uncut position.

11 Claims, 13 Drawing Sheets

(51) Int. Cl.

| | |
|---|---|
| ***B41J 3/407*** | (2006.01) |
| ***B41J 11/66*** | (2006.01) |
| *B41J 11/70* | (2006.01) |
| *B41J 2/32* | (2006.01) |

(52) U.S. Cl.
CPC ..... *B41J 11/663* (2013.01); *B41J 2/32* (2013.01); *B41J 11/70* (2013.01)

100

| CONVEYANCE SPEED JUST BEFORE INTERRUPTION | CORRECTION AMOUNT FOR CUT TARGET POSITION |
|---|---|
| ~10 (mm/s) | 1 (dot) |
| ~15 (mm/s) | 1 (dot) |
| ~20 (mm/s) | 2 (dots) |
| ~30 (mm/s) | 2 (dots) |
| ~40 (mm/s) | 3 (dots) |
| ~60 (mm/s) | 4 (dots) |
| ~80 (mm/s) | 5 (dots) |
| ~100 (mm/s) | 6 (dots) |

FIG. 7

PRINTER, AND METHOD AND COMPUTER-READABLE MEDIUM FOR THE SAME

CROSS-REFERENCE TO RELATED APPLICATION

This application claims priority under 35 U.S.C. §119 from Japanese Patent Application No. 2015-251133 filed on Dec. 24, 2015. The entire subject matter of the application is incorporated herein by reference.

BACKGROUND

Technical Field

The following description relates to aspects of a printer, a method, and a non-transitory computer-readable storage medium for printing images on a long print medium while conveying the print medium.

Related Art

A printer (hereinafter referred to as a "first-type printer") has been known that is configured to invalidate a particular sheet when a printing operation could not completely been performed up to an intended line on the particular sheet because of an electric power outage or an error caused during the printing operation. Further, a printer (hereinafter referred to as a "second-type printer") has been known that is configured to sequentially print a plurality of pages on a long print medium while conveying the print medium. In the second-type printer, it is possible to produce a label of each page by cutting the print medium, on which the plurality of pages have been sequentially printed, on a page-by-page basis.

SUMMARY

In the known first-type printer, the particular sheet on which the printing operation could not completely been performed up to the intended line is invalidated as a whole, and therefore might be discarded as waste. Further, in the known second-type printer, suppose for instance that when a second page has been continuously printed after a first page was printed, an error (e.g., an electric power outage) occurs before the print medium is cut in a boundary between the first page and the second page. In such a case, when the printer recovers from the error and resumes the printing operation, the printer prints the second page again from the beginning without cutting the print medium in the boundary between the first page and the second page. Hence, a user has to cut the print medium by user's own hands to produce a label of the first page.

Aspects of the present disclosure are advantageous to provide one or more improved techniques, for a printer, which make it possible to appropriately cut a print medium with images printed thereon even though an error is caused while printing is being performed on the print medium.

According to aspects of the present disclosure, a printer is provided, which includes a conveyor configured to convey a print medium in a conveyance direction along a conveyance path, a print head configured to sequentially print a plurality of page images on the print medium in a first position on the conveyance path, each page image being an image representing a single unit of page, a cutter configured to cut the print medium in a second position on the conveyance path, the second position being downstream of the first position in the conveyance direction, a first storage configured to store print data for printing each of the plurality of page images, a second storage configured to store a cut target position of the print medium to be cut by the cutter, and a controller configured to execute a printed matter producing process including controlling the print head to sequentially print the plurality of page images on the print medium based on the print data stored in the first storage, while controlling the conveyor to convey the print medium, storing into the second storage a cut target position for each of the page images printed on the print medium, and when the cut target position stored in the second storage reaches the second position, controlling the cutter to cut the print medium, an interrupting process including interrupting the printed matter producing process when an error occurs during the execution of the printed matter producing process, and storing an uncut position of the print medium into a particular storage, the uncut position being a cut target position located between the first position and the second position when the printed matter producing process is interrupted, and a first resuming process including resuming the printed matter producing process when the error is settled during the interruption of the printed matter producing process, and controlling the cutter to cut the print medium when the uncut position stored in the interrupting process reaches the second position.

According to aspects of the present disclosure, further provided is a method adapted to be implemented on a processor coupled with a printer including a conveyor, a print head, a cutter, a first storage, and a second storage. The method includes a printed matter producing process including controlling the print head to sequentially print a plurality of page images on the print medium in a first position on a conveyance path based on print data stored in the first storage while controlling the conveyor to convey a print medium in a conveyance direction along the conveyance path, storing into the second storage a cut target position for each of the page images printed on the print medium, the cut target position being a position of the print medium to be cut by the cutter, and controlling the cutter to cut the print medium in the second position when the cut target position stored in the second storage reaches a second position on the conveyance path, the second position being downstream of the first position in the conveyance direction, an interrupting process including interrupting the printed matter producing process when an error occurs during the execution of the printed matter producing process, and storing an uncut position of the print medium into a particular storage, the uncut position being a cut target position located between the first position and the second position when the printed matter producing process is interrupted, and a resuming process including resuming the printed matter producing process when the error is settled during the interruption of the printed matter producing process, and controlling the cutter to cut the print medium when the uncut position stored in the interrupting process reaches the second position.

According to aspects of the present disclosure, further provided is a non-transitory computer-readable medium storing computer-readable instructions that are executable by a processor coupled with a printer including a conveyor, a print head, a cutter, a first storage, and a second storage. The instructions are configured to, when executed by the processor, cause the processor to execute a printed matter producing process including controlling the print head to sequentially print a plurality of page images on the print medium in a first position on a conveyance path based on print data stored in the first storage while controlling the conveyor to convey a print medium in a conveyance direction along the conveyance path, storing into the second storage a cut target position for each of the page images printed on the print medium, the cut target position being a position of the print medium to be cut by the cutter, and controlling the cutter to cut the print medium in the second position when the cut target position stored in the second storage reaches a second position on the conveyance path, the second position being downstream of the first position in the conveyance direction, an interrupting process including interrupting the printed matter producing process, and storing an uncut position of the print medium into a particular storage when an error occurs during the execution of the printed matter producing process, the uncut position being a cut target position located between the first position and the second position when the printed matter producing process is interrupted, and a resuming process including resuming the printed matter producing process when the error is settled during the interruption of the printed matter producing process, and controlling the cutter to cut the print medium when the uncut position stored in the interrupting process reaches the second position.

BRIEF DESCRIPTION OF THE ACCOMPANYING DRAWINGS

FIG. 7 exemplifies a correction table in the illustrative embodiment according to one or more aspects of the present disclosure.

Figure 8A:
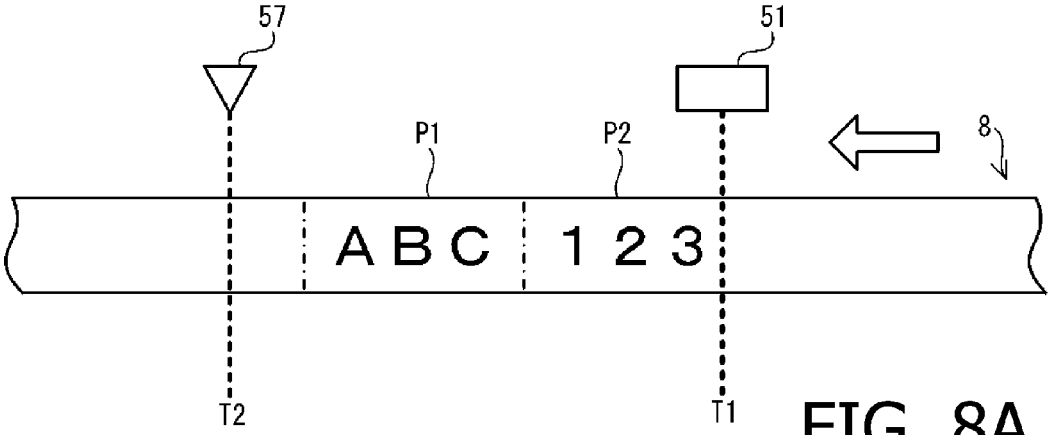
Figure 8B:
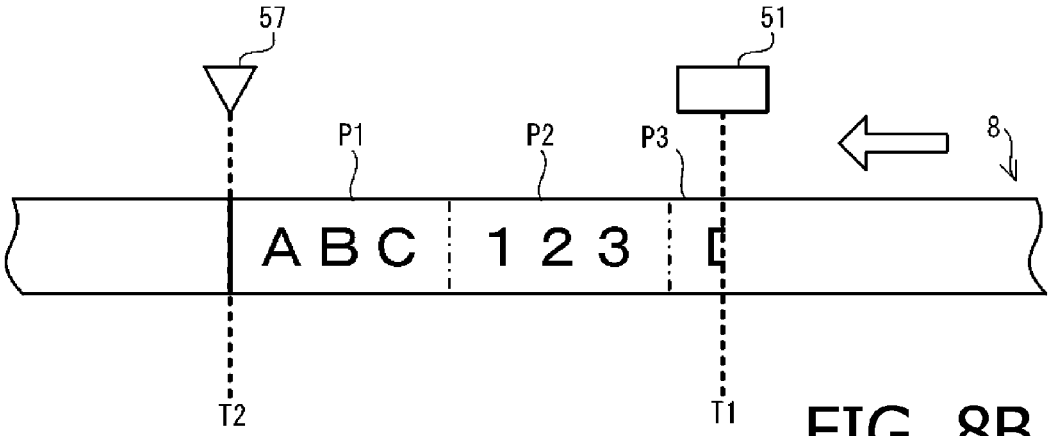
Figure 8C:
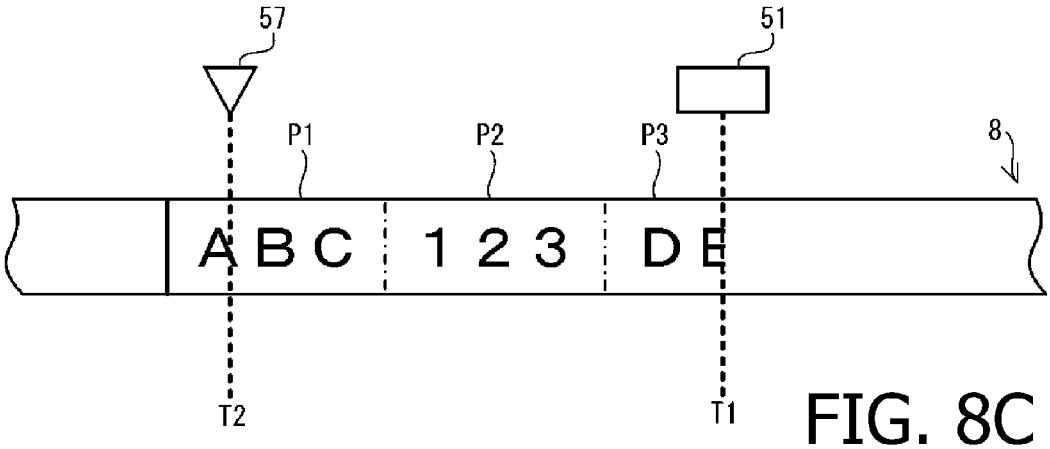

FIGS. 8A, 8B, and 8C are illustrations showing a flow of a printed matter producing process in the illustrative embodiment according to one or more aspects of the present disclosure.

Figure 9A:
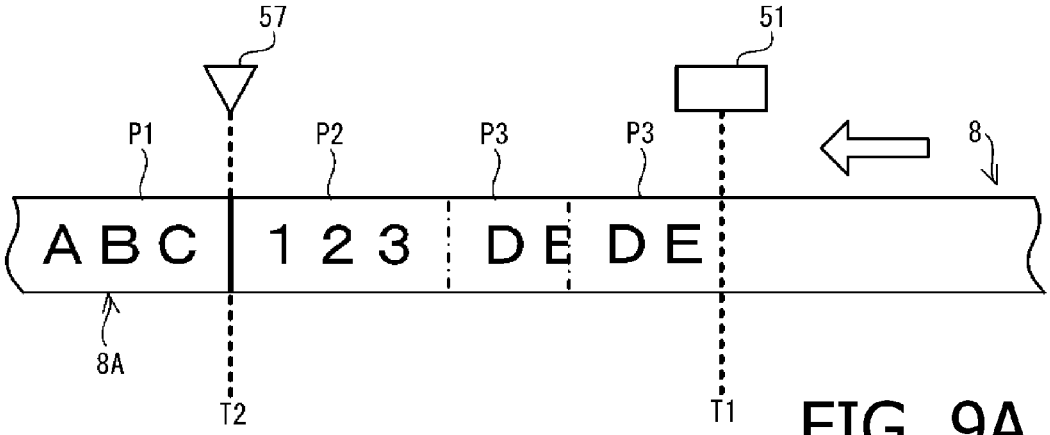
Figure 9B:
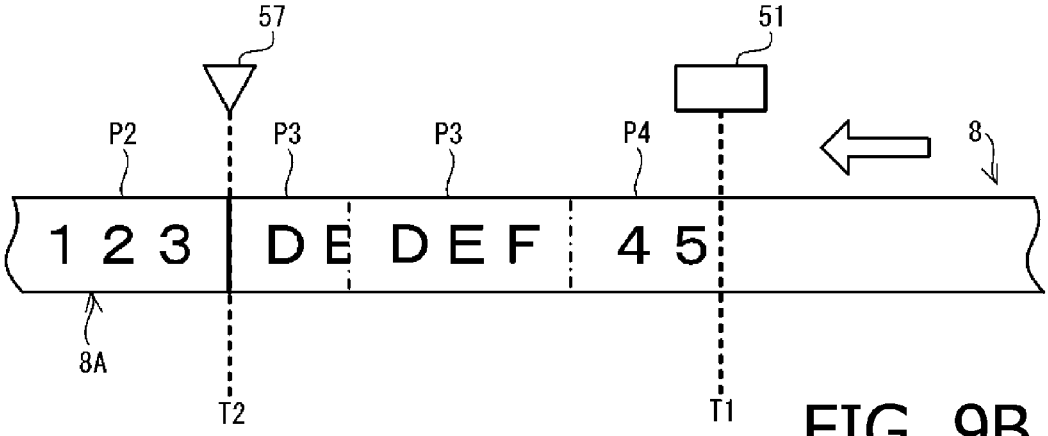
Figure 9C:
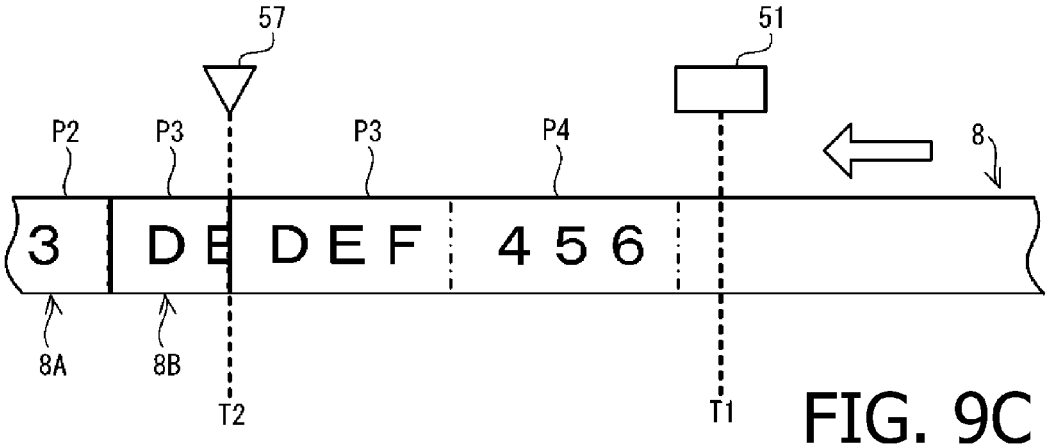

FIGS. 9A, 9B, and 9C are illustrations showing a flow of the printed matter producing process in the illustrative embodiment according to one or more aspects of the present disclosure.

FIGS. 10A, 10B, 10C, and 10D are illustrations showing a flow of the printed matter producing process in the illustrative embodiment according to one or more aspects of the present disclosure.

Figure 11A:
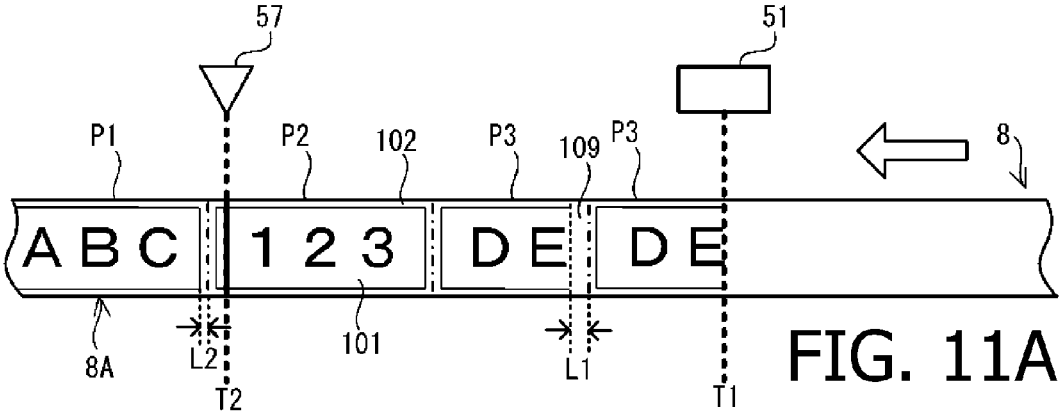
Figure 11B:
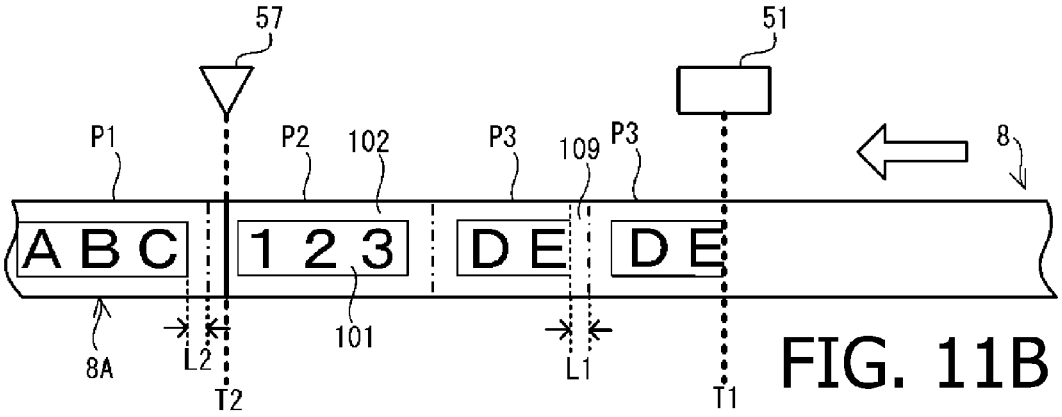

FIGS. 11A and 11B are illustrations showing a flow of the printed matter producing process in the illustrative embodiment according to one or more aspects of the present disclosure.

Figure 12A:
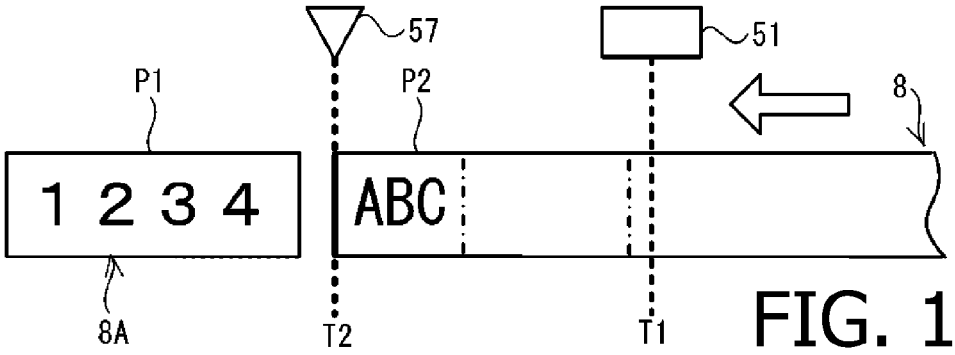
Figure 12B:
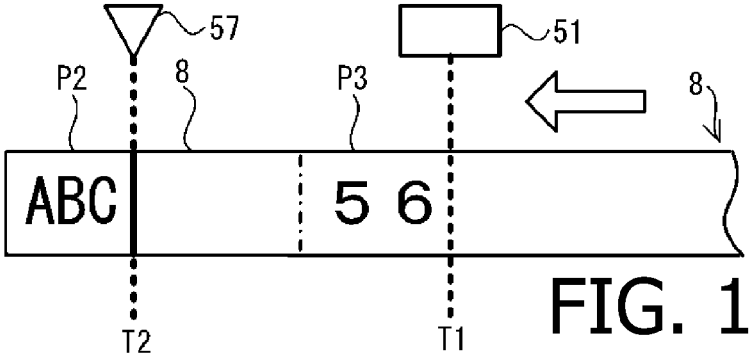
Figure 12C:
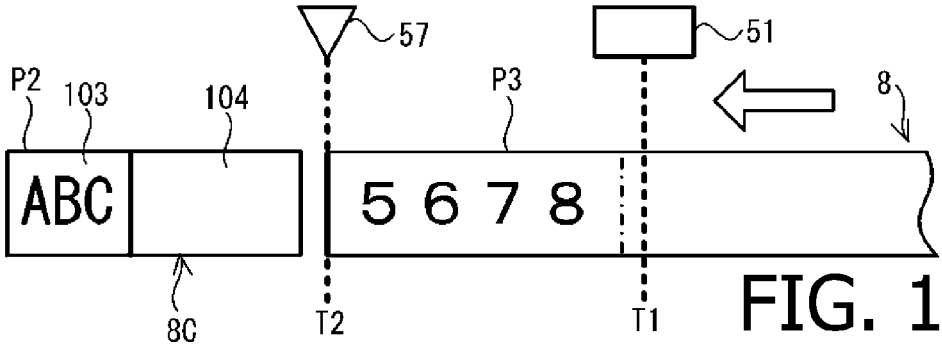

FIGS. 12A, 12B, and 12C are illustrations showing a flow of the printed matter producing process in the illustrative embodiment according to one or more aspects of the present disclosure.

Figure 13A:
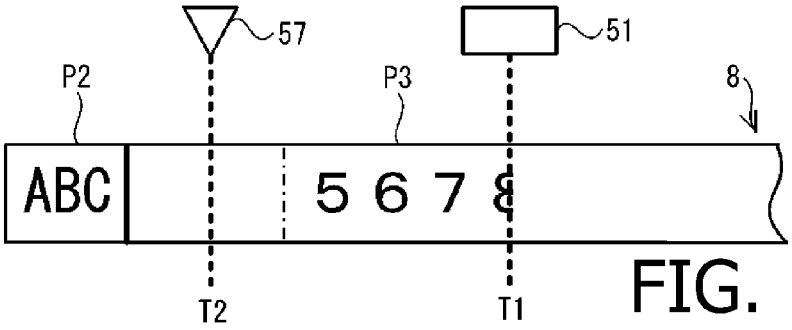
Figure 13B:
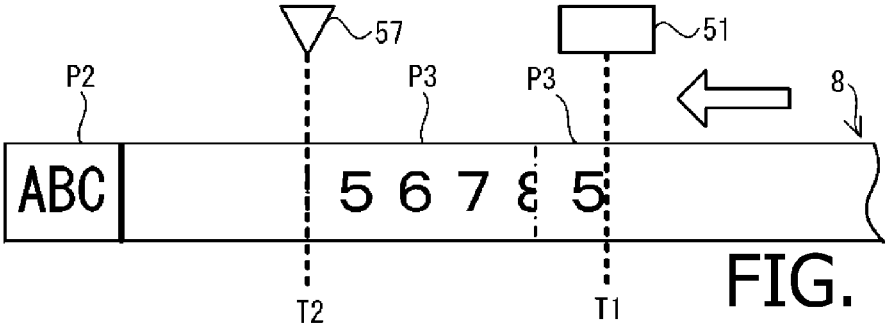
Figure 13C:
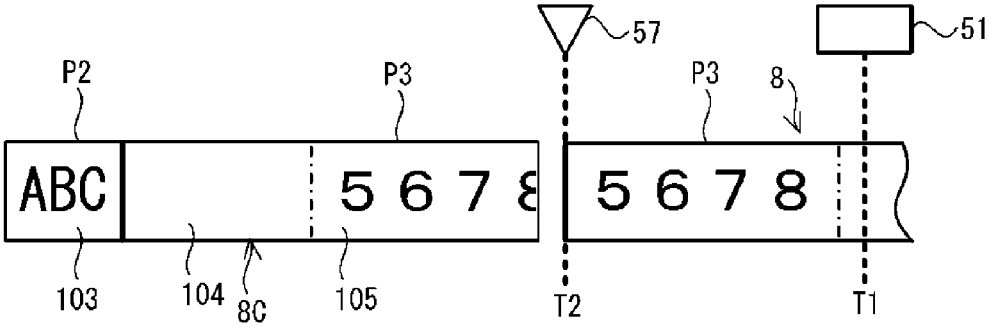

FIGS. 13A, 13B, and 13C are illustrations showing a flow of the printed matter producing process in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an illustrative embodiment according to aspects of the present disclosure will be described with reference to the accompanying drawings. In the following description, an upside, a downside, a left side, a right side, a front side, and a rear side of a printer 1 of the illustrative embodiment will be defined as shown in FIG. 1.

Figure 1:
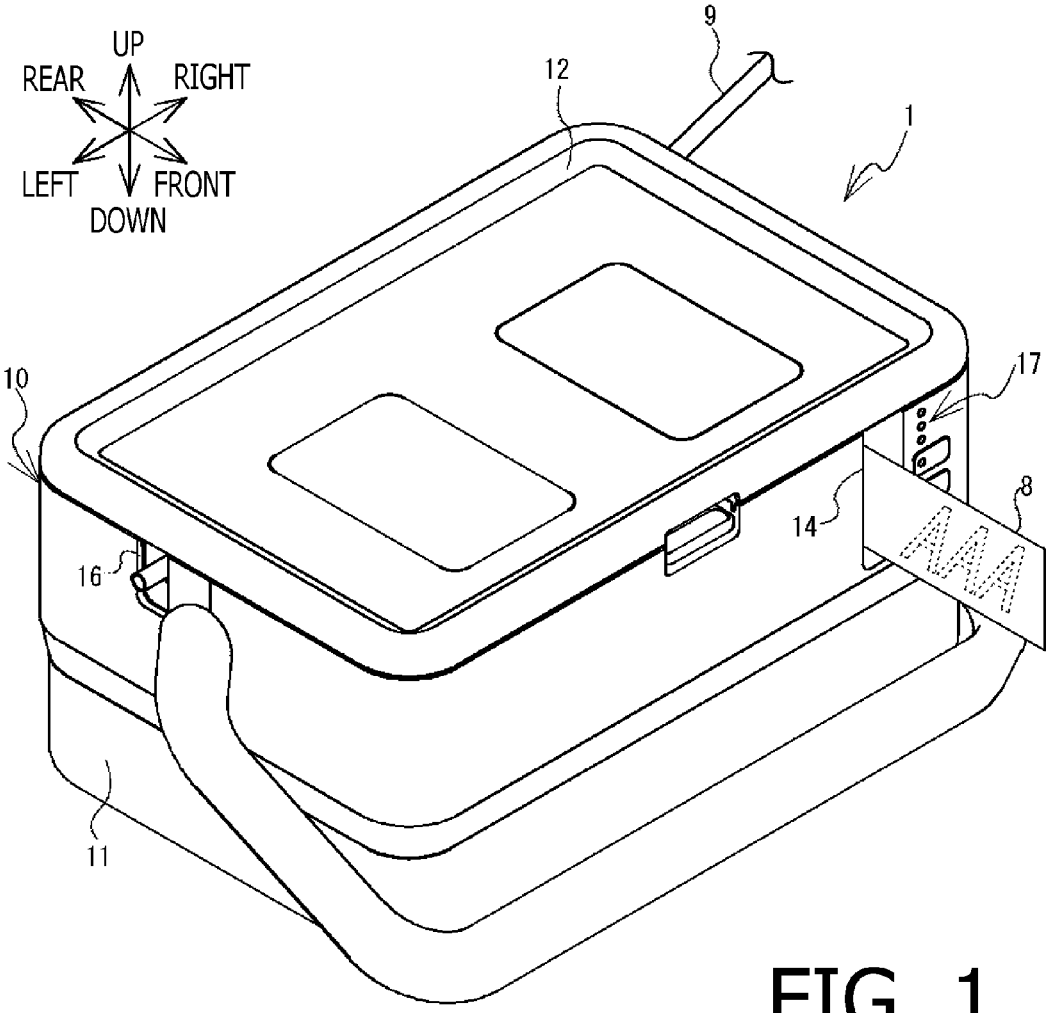
FIG. 1 is a perspective view showing a printer when viewed from an upper front left side, in an illustrative embodiment according to one or more aspects of the present disclosure.

As shown in FIG. 1, the printer 1 includes two printing mechanisms, and is configured to perform printing on a tape 8 and a tube 9 with the two printing mechanisms, respectively. The tape 8 is a strip-shaped print medium. The tube 9 is a tubular print medium. The printer 1 includes a housing 10. The housing 10 includes a main body casing 11 and a cover 12. The main body casing 11 is formed in the shape of a rectangular parallelepiped box having a longitudinal direction along a left-to-right direction. The cover 12 is a plate-shaped member disposed above the main body casing 11. A rear end portion of the cover 12 is rotatably supported by an upper rear end portion of the main body casing 11. When the cover 12 is closed relative to the main body casing 11 (see FIG. 1), the cover 12 covers an attachment surface 11A (see FIG. 2). When the cover 12 is open relative to the main body casing 11, the attachment surface 11A is exposed upward (see FIG. 2).

At side surfaces of the housing 10, a tape outlet 14, a tube inlet 15, a tube outlet 16, and a user interface 17 are disposed. The tape outlet 14 is disposed at a front surface of the housing 10. The tape outlet 14 is an opening for discharging the tape 8 out of the housing 10 therethrough. The tube inlet 15 is disposed at a right surface of the housing 10. The tube inlet 15 is an opening for introducing the tube 9 into the housing 10 therethrough. The tube outlet 16 is disposed at a left surface of the housing 10. The tube outlet 16 is an opening for discharging the tube 9 out of the housing 10 therethrough. The user interface 17 includes a display and operable members. The display includes a plurality of LEDs configured to show an operating condition of the printer 1. The operable members include a plurality of operable buttons such as a power button and a start button.

Figure 2:
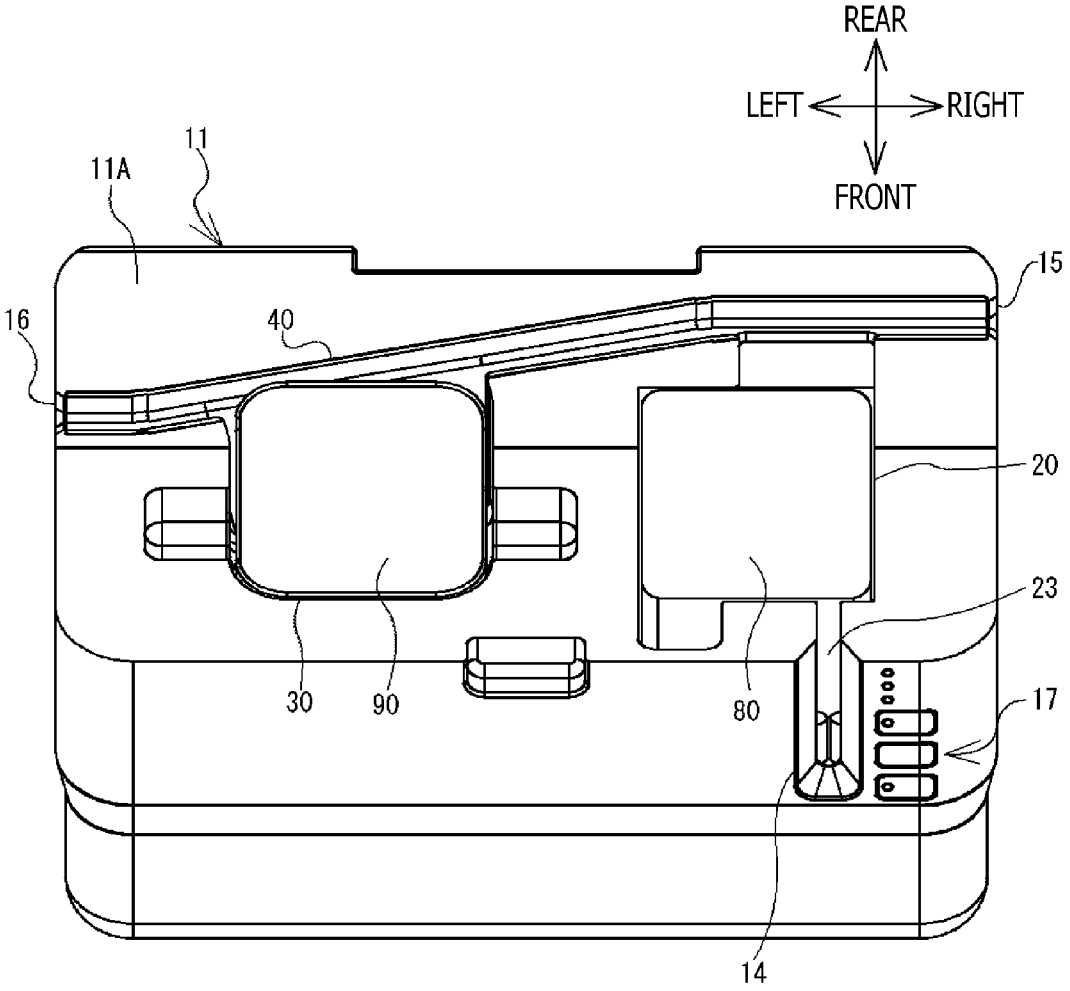
FIG. 2 is a perspective view showing a main body casing of the printer when viewed from an upper front side, in the illustrative embodiment according to one or more aspects of the present disclosure.

As shown in FIG. 2, at the attachment surface 11A, a tape attachment section 20, a ribbon attachment section 30, and a tube attachment section 40 are disposed. The tape attachment section 20 is a recessed section having an open upper side. The tape attachment section 20 is configured such that a tape cassette 80 is detachably attached thereto. In the illustrative embodiment, the tape attachment section 20 is positioned at a right portion of the attachment surface 11A. When the cover 12 is open (see FIG. 1), a user is allowed to detachably attach the tape cassette 80 to the tape attachment section 20 from above. A conveyance guide 23 is a groove that continuously extends frontward from a front right portion of the tape attachment section 20. A front end portion of the conveyance guide 23 is connected with the tape outlet 14.

The ribbon attachment section 30 is a recessed section having an open upper side. The ribbon attachment section 30 is configured such that a ribbon cassette 90 is detachably attached thereto. In the illustrative embodiment, the ribbon attachment section 30 is positioned at a left portion of the attachment surface 11A. When the cover 12 is open, the user is allowed to detachably attach the ribbon cassette 90 to the ribbon attachment section 30 from above. The tube attachment section 40 is configured such that the tube 9 (see FIG. 1) is detachably attached thereto.

The tube attachment section 40 is an upward-open groove extending from the tube inlet 15 to the tube outlet 16. In the illustrative embodiment, the tube attachment section 40 passes behind the tape attachment section 20 and the ribbon attachment section 30. Further, the tube attachment section 40 communicates with a rear end portion of the ribbon attachment section 30. When the cover 12 is open, the user is allowed to detachably attach the tube 9 to the tube attachment section 40 from above. The tube 9 is attached to the tube attachment section 40, so as to extend from the tube inlet 15 to the tube outlet 16.

Figure 3:
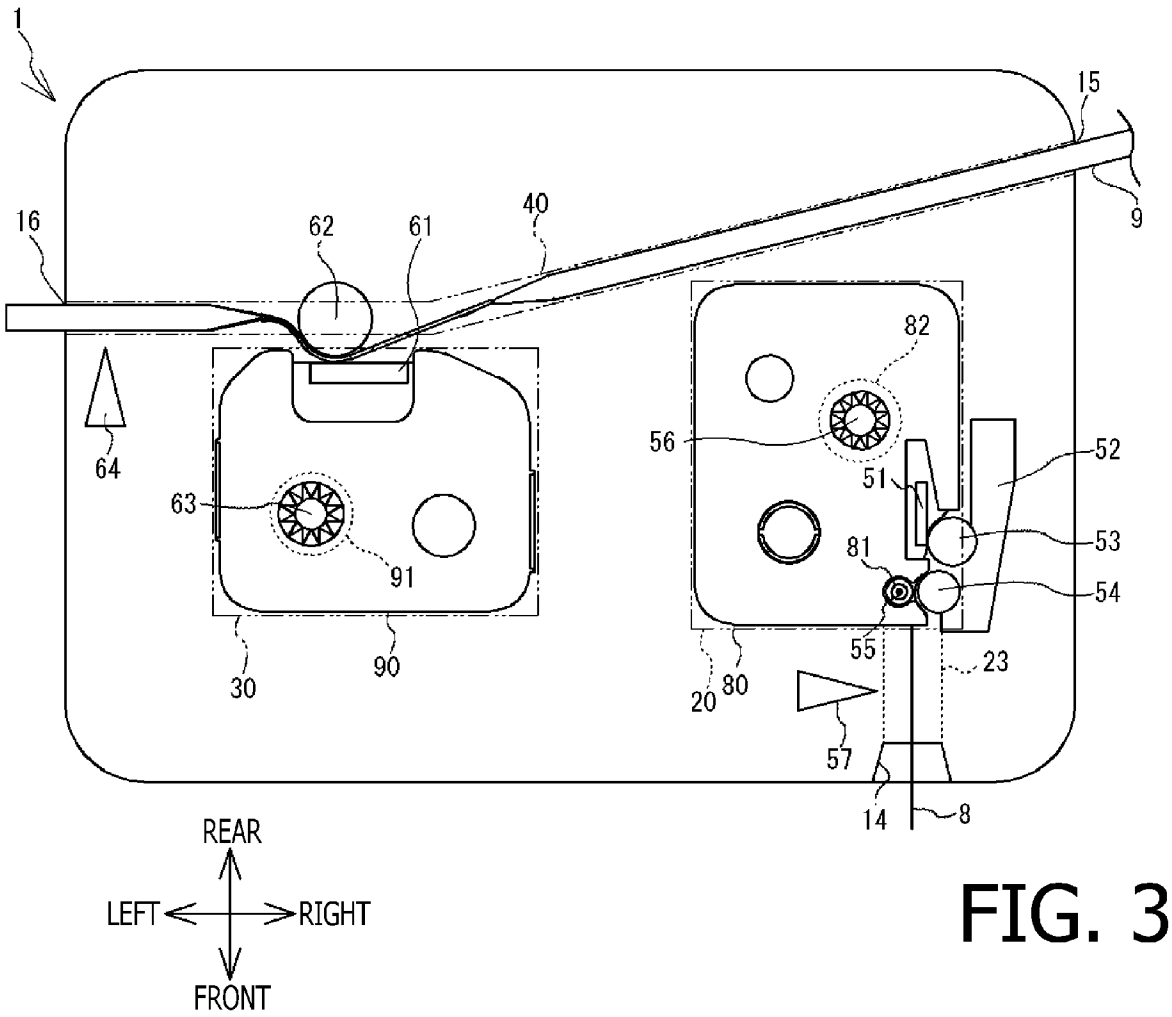
FIG. 3 is a plain view schematically showing an internal configuration of the printer in the illustrative embodiment according to one or more aspects of the present disclosure.

As shown in FIG. 3, the tape cassette 80 is formed in a box shape and configured to accommodate the unused tape 8, an unused ink ribbon (not shown), a tape driving roller 81, and a ribbon winding spool 82. The tape driving roller 81 is configured to pull the tape 8 out of the tape cassette 80. The ribbon winding spool 82 is configured to wind the ink ribbon in the tape cassette 80.

The tape attachment section 20 includes a print head 51, a tape driving shaft 55, and a ribbon winding shaft 56. The print head 51 is a thermal head configured to perform line-by-line printing using a plurality of printing elements arranged in a direction perpendicular to a conveyance direction of the tape 8. The tape driving shaft 55 is configured to rotate the tape driving roller 81. The ribbon winding shaft 56 is configured to rotate the ribbon winding spool 82. On the right of the tape attachment section 20, a platen holder 52 is disposed. The platen holder 52 is configured to rotatably support a platen roller 53 and a movable conveyance roller 54. The platen roller 53 is opposed to the print head 51 and rotatable relative to the print head 51. The movable conveyance roller 54 is opposed to the tape driving shaft 55 and rotatable relative to the tape driving shaft 55.

When the cover 12 (see FIG. 1) is opened, the platen holder 52 moves to a retreat position such that the platen roller 53 and the movable conveyance roller 54 are placed outside the tape attachment section 20. When the user attaches the tape cassette 80 to the tape attachment section 20, the tape driving shaft 55 and the ribbon winding shaft 56 are inserted into the tape driving roller 81 and the ribbon winding spool 82, respectively.

Subsequently, when the cover 12 is closed, the platen holder 52 moves to an operating position such that the platen roller 53 and the movable conveyance roller 54 are placed inside the tape attachment section 20. At this time, the platen roller 53 urges, toward the print head 51, the tape 8 and the ink ribbon of the tape cassette 80 in an overlapped manner. The movable conveyance roller 54 pinches the tape 8 and the ink ribbon of the tape cassette 80 with the tape driving roller 81. Thereby, the printer 1 is placed in a printable state where the printer 1 is allowed to perform printing on the tape 8 of the tape cassette 80.

Behind the tape outlet 14 (i.e., on a rear side of the tape outlet 14), a cutter 57 is disposed. The cutter 57 is configured to cut the tape 8 laid in the conveyance guide 23 in a thickness direction of the tape 8. More specifically, the cutter 57 is capable of half cutting to cut a part (e.g., only a release paper) of layers of the tape 8 thereby forming a slit, and is capable of full cutting to cut off all (e.g., the release paper and a mount) of the layers of the tape 8.

The ribbon cassette 90 is formed in a box shape and configured to accommodate an unused ink ribbon and a ribbon winding spool 91. The ribbon attachment section 30 includes a print head 61, a movable conveyance roller 62, and a ribbon winding shaft 63. The print head 61 is a thermal head configured to perform line-by-line printing by a plurality of printing elements arranged in a direction perpendicular to a conveyance direction of the tube 9. The movable conveyance roller 62 is opposed to the print head 61 and rotatable relative to the print head 61. The ribbon winding shaft 63 is configured to rotate the ribbon winding spool 91.

When the cover 12 (see FIG. 1) is opened, the movable conveyance roller 62 is placed behind the tube attachment section 40 and separated away from the print head 61. When the user attaches the ribbon cassette 90 to the ribbon attachment section 30, the ribbon winding shaft 63 is inserted into the ribbon winding spool 91. The user attaches the tube 9 to the tube attachment section 40. Subsequently, when the cover 12 is closed, the movable conveyance roller 62 is placed inside the tube attachment section 40 and positioned close to the print head 61. At this time, the movable conveyance roller 62 urges, toward the print head 61, the tube 9 attached to the tube attachment section 40 and the ink ribbon of the ribbon cassette 90 in an overlapped manner. Thereby, the printer 1 is placed into a state where the printer 1 is allowed to perform printing on the tube 9 with the ribbon cassette 90.

On the right of the tube outlet 16, a cutter 64 is disposed. The cutter 64 is configured to cut the tube 9 attached to the tube attachment section 40 in a radial direction of the tube 9. The cutter 64 is capable of half cutting to cut a part of the tube 9 in the radial direction thereby forming a slit, and is capable of full cutting to completely cut off the tube 9 in the radial direction.

Figure 4:
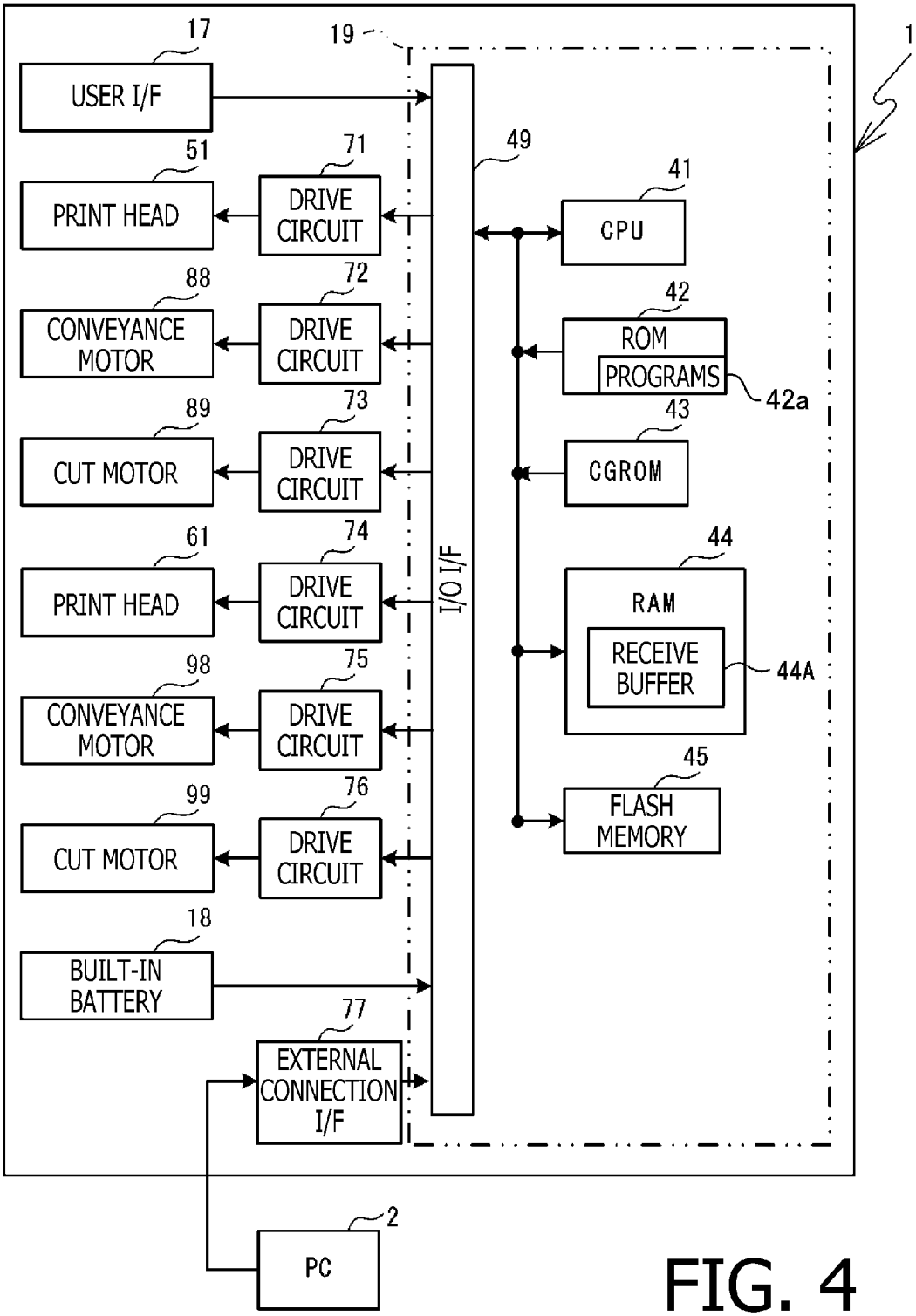
FIG. 4 is a block diagram showing an electrical configuration of the printer in the illustrative embodiment according to one or more aspects of the present disclosure.

Referring to FIG. 4, an electrical configuration of the printer 1 will be described. The printer 1 includes a control board 19. The control board 19 includes a CPU 41, a ROM 42, a CGROM 43, a RAM 44, a flash memory 45, and an input/output interface (hereinafter, which may be referred to as an I/O I/F) 49 interconnected via a data bus. The ROM 42 stores programs 42*a* to be executed by the CPU 41 to take control of the printer 1. The CGROM 43 stores print dot pattern data for printing characters. The characters include at least one of letters, letter strings, numerals, symbols, figures, and illustrations. The RAM 44 is configured to temporarily store data. The RAM 44 includes a receive buffer 44A configured to temporarily store print data received from an external device. The flash memory 45 is configured to store characters acquired from an external device, and store a below-mentioned correction table 100 (see FIG. 7).

The I/O I/F 49 is connected with an operation interface 17, a built-in battery 18, drive circuits 71, 72, 73, 74, 75, and 76, and an external connection I/F 77. When the printer 1 is connected with an external power supply (not shown), the built-in battery 18 is supplied with electricity from the external power supply and is charged. When the printer 1 is not connected with the external power supply, the built-in battery 18 supplies electric power charged therein to the printer 1.

The drive circuit 71 includes an electronic circuit configured to drive the print head 51. The drive circuit 72 includes an electronic circuit configured to drive a conveyance motor 88 for rotating the tape driving shaft 55 and the ribbon winding shaft 56. The drive circuit 73 includes an electronic circuit configured to drive the cut motor 89 for operating the cutter 57. The drive circuit 74 includes an electronic circuit configured to drive the print head 61. The drive circuit 75 includes an electronic circuit configured to drive a conveyance motor 98 for rotating the movable conveyance roller 62 and the ribbon winding shaft 63. The drive circuit 76 includes an electronic circuit configured to drive a cut motor 99 for operating the cutter 64.

The external connection I/F 77 is an interface for connecting an external device with the printer 1. In the illustrative embodiment, a PC 2, as an external device, is connected with the printer 1 via the external connection I/F 77. In the PC 2, an editor is installed that is an application program for the user to edit page images. Each page image represents print contents, including at least one character, for a single unit of page. The user edits page images with the editor on the PC 2, and thereafter issues an instruction to print the page images. In the illustrative embodiment, each page image includes an image area 101 in which one or more characters are printed, and a margin area 102 provided around the image area 101 (see FIGS. 11A and 11B).

In this case, a CPU (not shown) of the PC 2 transmits to the printer 1 a print command for instructing the printer 1 to print the edited page images. In the illustrative embodiment, the print command indicates which print medium (the tape 8 or the tube 9) the page images are to be printed on, the number of pages to be printed, and print information for each page image. The print information for each page image indicates the number of print lines for the page image and cut settings (e.g., a cutting type and a cut target position). The cutting type indicates one of full cutting and half cutting. The cut target position indicates a position to be cut of the tape 8 with the page image printed thereon.

In the illustrative embodiment, when a page image is a normal page image, the printer 1 is allowed to produce a label 8A (see FIG. 9A) on the entire surface of which the page image is printed. The normal page image is a page image having a page length equal to or more than a lower limit (e.g., 10 mm). It is noted that the page length is a length of a page in the conveyance direction. The cut target positions for a normal page image corresponding to the top page (i.e., the first page) are a head line and a bottom line (i.e., both ends in the conveyance direction) of the page image. The cut target position for a normal page image corresponding to each of the following pages (i.e., the second and subsequent pages) is a bottom line of the page image.

In the illustrative embodiment, when a page image is a special page image, the printer 1 is allowed to produce a special label 8C (see FIG. 12C). The special page image is a page image having a page length less than the lower limit. The special label 8C is such a label that a page image is printed on a page section 103. The page section 103 has a length equal to the lower limit in the conveyance direction, and is a downstream portion of the special label 8C in the conveyance direction. The special label 8C is half-cut in a boundary position (i.e., a bottom line of the page image) between the page section 103 and a margin section 104. The margin section 104 is positioned upstream of the page section 103 in the conveyance direction.

Accordingly, the cut target positions for a special page image corresponding to the top page are a head line, a bottom line, and a margin-added line of the special page image. The margin-added line is positioned a distance of the lower limit upstream of the head line of the page image in the conveyance direction. In this case, the cutting type to be applied for the head line and the margin-added line is "full cutting." Meanwhile, the cutting type to be applied for the bottom line is "half cutting."

Further, the CPU of the PC 2 sequentially generates line-by-line print data based on the edited page images, and sequentially transmits the generated print data to the printer 1. Each piece of the line-by-line print data causes the printer 1 to print, as a print unit, a single line of the page images to be printed by the print head 51 or the print head 61. Thereby, a plurality of pieces of print data, required for printing all of the page images to be printed, are sequentially transmitted from the PC 2 to the printer 1. When there exist a plurality of page images to be printed, a plurality of pieces of print data, each of which represents a corresponding page image, are transmitted in accordance with a sequence in which the plurality of page images are to be printed.

In the printer 1, the received print command and the received print data are stored into the receive buffer 44A. The CPU 41 reads the print command and the print data out of the receive buffer 44A in the stored order. When reading out the print command from the receive buffer 44A, the CPU 41 begins to perform a below-mentioned printed matter producing process. When reading out print data from the receive buffer 44A, the CPU 41 converts the print data into image data of a single line, based on the print dot pattern data stored in the CGROM 43. Then, the CPU 41 stores the image data generated through the conversion, into an image buffer (not shown) of the RAM 44. The CPU 41 executes the following printed matter producing process while sequentially reading out image data stored in the image buffer.

When reading out a print command regarding the tape 8, the CPU 41 starts the printed matter producing process on the tape 8. As shown in FIG. 3, the conveyance motor 88 rotates the tape driving shaft 55 and the ribbon winding shaft 56 thereby rotating the tape driving roller 81 and the ribbon winding spool 82. Along with rotation of the tape driving roller 81, an unused tape 8 is pulled out of the tape cassette 80. Along with rotation of the ribbon winding spool 82, an unused ink ribbon is pulled out of the tape cassette 80. The pulled-out tape 8 and the pulled-out ink ribbon 86 are fed between the print head 51 and the platen roller 53.

The print head 51 prints characters on the tape 8 with the ink ribbon, based on the image data sequentially read out from the image buffer, in synchronization with conveyance of the tape 8. The used ink ribbon is wound by the ribbon winding spool 82. The printed tape 8 is conveyed into the conveyance guide 23 by the movable conveyance roller 54 and the tape driving roller 81. Further, the printed tape 8 is cut by the cutter 57 on a page-image-by-page-image basis, and discharged from the tape outlet 14.

When reading out a print command regarding the tube 9, the CPU 41 starts a printed matter producing process on the tube 9. As shown in FIG. 3, the conveyance motor 98 rotates the movable conveyance roller 62 to convey the tube 9 in the tube attachment section 40, and rotates the ribbon winding shaft 63 to rotate the ribbon winding spool 91. Along with rotation of the ribbon winding spool 91, an unused ink ribbon is pulled out of the ribbon cassette 90. The pulled-out ink ribbon is fed between the print head 61 and the movable conveyance roller 62.

The print head 61 prints characters on the tube 9 with the ink ribbon, based on the image data sequentially read out from the image buffer, in synchronization with conveyance of the tube 9. The used ink ribbon is wound by the ribbon winding spool 91. The printed tube 9 is conveyed downstream of the print head 61 in the conveyance direction of the tube 9, by the movable conveyance roller 62. Further, the printed tube 9 is cut by the cutter 64 on a page-image-by-page-image basis, and discharged from the tube outlet 16.

Referring to FIGS. 5 to 13C, a main process for the printed matter producing process will be described. FIGS. 8A to 8C schematically show a positional relationship among the tape 8, the print head 51, and the cutter 57 in the printed matter producing process for the sake of easy understanding (the same applies to FIGS. 9A to 13C). When reading out the print command from the receive buffer 44A, the CPU 41 launches the main process by loading and executing one or more programs 42*a* stored in the ROM 42.

In the following description, a printed matter producing process to be performed on the tape 8 based on the main process will be exemplified. It is noted, in this regard, that the same may apply to a printed matter producing process to be performed on the tube 9 based on the main process. As shown in FIGS. 8A to 8C, a position where the tape 8 is cut in a width direction thereof by the cutter 57 is referred to as a "cutter position T2." A position where a single line of character is printed on the tape 8 by the print head 51 is referred to as a "head position T1." The cutter position T2 is located downstream of the head position T1 in the conveyance direction of the tape 8.

Figure 5:
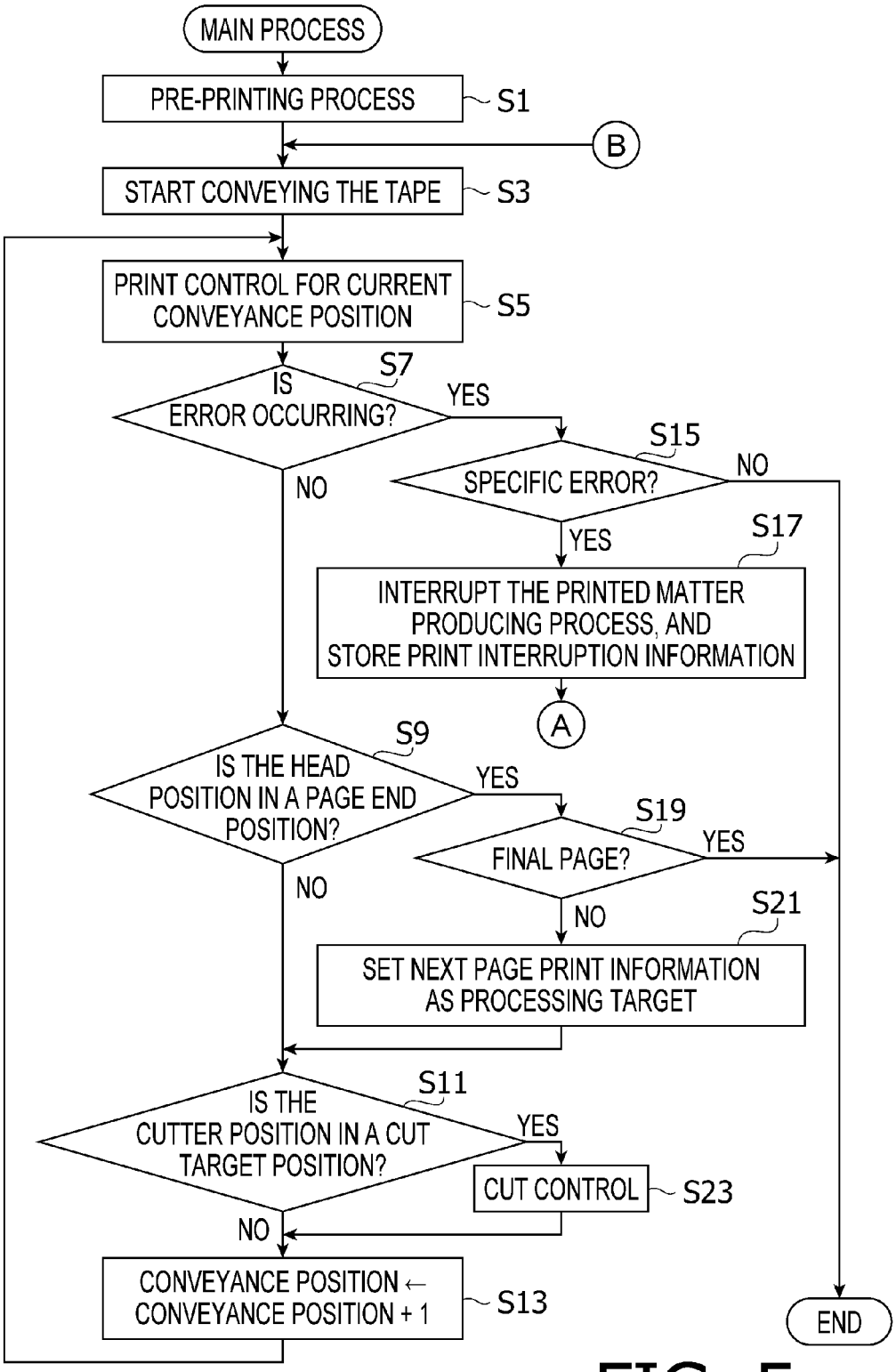
FIGS. 5 and 6 are flowcharts showing a procedure of a main process to be executed by the printer in the illustrative embodiment according to one or more aspects of the present disclosure.

As shown in FIG. 5, firstly, the CPU 41 performs a pre-printing process (S1). Specifically, the CPU 41 stores the number of pages to be printed and the print information of each page image into a particular area of the RAM 44 based on the print command read out from the receive buffer 44A. In the particular area of the RAM 44, the CPU 41 sets the print information of the page image corresponding to the top page, as a processing target. The CPU 41 sets the cut target position for the page image corresponding to the top page, in a cut-setting area of the RAM 44. The CPU 41 initializes a current conveyance position (unit: dots) stored in the RAM 44 to "zero."

Afterward, the CPU 41 begins to convey the tape 8 by driving the conveyance motor 88 (S3). Then, the CPU 41 performs print control for the current conveyance position (S5). Specifically, the CPU 41 reads out image data for printing a line corresponding to the current conveyance position on the tape 8, from the image buffer of the RAM 44, based on the print information of the processing target set in the RAM 44. The CPU 41 controls the print head 51 to print a single line based on the read image data.

Subsequently, the CPU 41 determines whether an error is occurring (S7). When determining that an error is not occurring (S7: No), the CPU 41 determines whether the head position T1 is in a page end position, based on the current conveyance position stored in the RAM 44 (S9). Specifically, when the head position T1 is not coincident with the bottom line of a page image being printed (i.e., an upstream end of the page image being printed in the conveyance direction) in the conveyance direction, the CPU 41 determines that the head position T1 is not in the page end position (S9: No).

In this case, the CPU 41 determines whether the cutter position T2 is in a cut target position (S11). Specifically, when the cutter position T2 is not coincident with the cut target position set in the cut-setting area of the RAM 44 in the conveyance direction, the CPU 41 determines that the cutter position T2 is not in the cut target position (S11: No). In this case, the CPU 41 increments the current conveyance position stored in the RAM 44 by one (S13), and then goes back to S1.

When determining that an error is occurring (S7: Yes), the CPU 41 determines whether the error is a specific error (S15). The specific error may be an error that could be settled by simple user operations. Examples of the specific error may include an error caused due to an electric power shortage of the printer 1 and an error caused when the cover 12 is improperly opened. The electric power shortage of the printer 1 is a state where an electric power supplied to the printer 1 is reduced to less than a reference value from equal to or more than the reference value. For instance, the electric power shortage of the printer 1 might be caused due to a power failure of an external power supply connected with the printer 1, breaking of a power cable connected with the printer 1, or a reduction in electric power charged in the built-in battery 18. It is noted that even though the electric power shortage of the printer 1 occurs, the electric power remaining in the built-in battery 18 is supplied to the control board 19, and therefore various kinds of data stored in the RAM 44 are safely saved.

When determining that the error is a specific error (S15: Yes), the CPU 41 interrupts the printed matter producing process by stopping conveyance of the tape 8 and printing on the tape 8, and stores print interruption information into the RAM 44 (S17). In the illustrative embodiment, the print interruption information includes print information of a print-interrupted page, print information of uncut pages, and a conveyance speed just before interruption. The print-interrupted page is a page image only a part of which is printed because of the interruption of the printed matter producing process. The uncut pages are normal page images of which the bottom lines are not cut or special page images of which the margin-added lines are not cut, among page images positioned downstream of the head position T1 at the time when the printed matter producing process is interrupted. Each of the print information of the print-interrupted page and the print information of the uncut pages includes an uncut position. The uncut position is a cut target position located between the head position T1 and the cutter position T2 at the time of the interruption of the printed matter producing process. The conveyance speed just before interruption is a conveyance speed of the tape 8 immediately before the interruption of the printed matter producing process.

When determining that the error is not a specific error (S15: No), the CPU 41 determines that the error is a non-specific error. For instance, the non-specific error may be an error that could not be settled by simple user operations. Examples of the non-specific error may include an error caused due to malfunction of the printer 1 and an error caused when the tape cassette 80 needs to be replaced. In this case, the CPU 41 interrupts the printed matter producing process, and terminates the main process after performing a process required depending on a type of the error.

When the head position T1 is coincident in the conveyance direction with the bottom line of the page image being printed, the CPU 41 determines that the head position T1 is in the page end position (S9: Yes). In this case, the CPU 41 determines whether the printed page image corresponds to a final page, based on the number of pages to be printed that is indicated by the print command (S19). When determining that the printed page image does not correspond to the final page (S19: No), the CPU 41 sets next page print information as a processing target, based on the print command (S21).

The next page print information is print information of a next page image to be printed (hereinafter, simply referred to as a "next page image"). In S21, the CPU 41 sets the bottom line of the next page image as a new cut target position in the cut-setting area of the RAM 44. Further, the CPU 41 stores the cutting type for the newly-set cut target position into the cut-setting area. After S21, the CPU 41 goes to S11. When determining that the printed page image corresponds to the final page (S19: Yes), the CPU 41 further conveys the tape 8, and controls the cutter 57 to full-cut (i.e., completely cut off) the bottom line of the final page in the cutter position T2. Thereafter, the CPU 41 terminates the main process.

When the cutter position T2 is coincident in the conveyance direction with the cut target position set in the cut-setting area of the RAM 44, the CPU 41 determines that the cutter position T2 is in the cut target position (S11: Yes). In this case, the CPU 41 drives the cut motor 89 and performs cut control (S23). Specifically, the CPU 41 controls the cutter 57 to perform half cutting or full cutting in accordance with the cutting type for the cut target position. Thereby, the cut target position of the tape 8 is cut in accordance with the cutting type.

In S23, when the bottom line of the page image is cut, a label 8A (see FIGS. 9A to 9C) of a single page unit is produced. The CPU 41 deletes, from the particular area of the RAM 44, the print information and the print data of the page image corresponding to the produced label 8A among the print information and the print data read out from the receive buffer 44A. After S23, the CPU 41 goes to S13.

Figure 6:
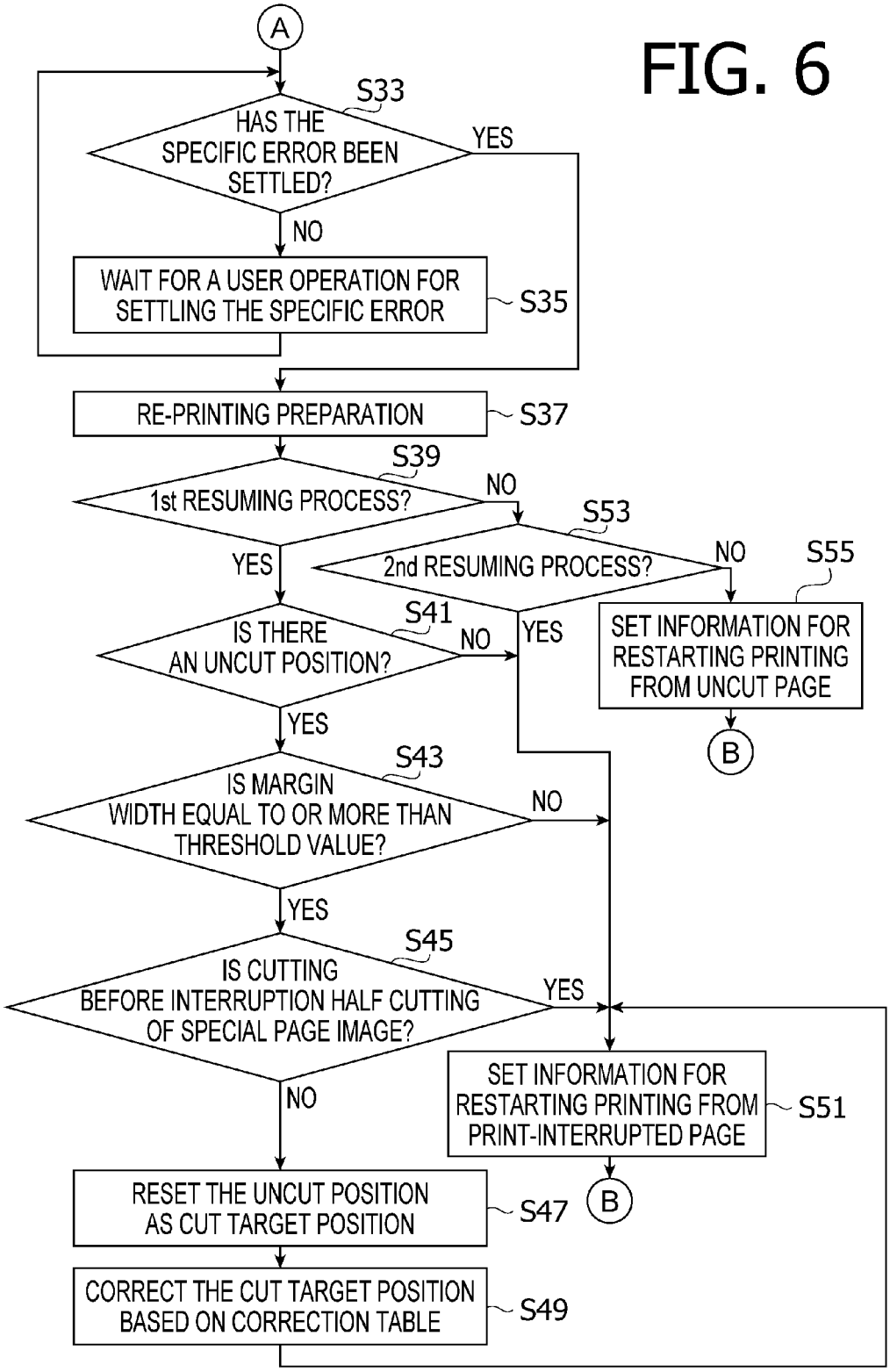

As shown in FIG. 6, the CPU 41 determines whether the specific error has been settled (S33). When determining that the specific error has not been settled (S33: No), the CPU 41 waits for a user operation for settling the specific error (S35) and goes back to S33. For instance, when the specific error is an error caused due to electric power shortage of the printer 1, the user may solve the power failure of the external power supply or restore the broken power cable as a user operation for settling the specific error. Thereby, as the amount of electricity supplied to the printer 1 is brought back to a level equal to or more than the reference value, the CPU 41 determines that the specific error has been settled (S33: Yes).

Thus, when the specific error has been settled, the CPU 41 executes a re-printing preparation for bringing the printer 1 back to an operable state in order to resume the printed matter producing process (S37). At this time, the CPU 41 deletes the cut target position stored in the cut-setting area of the RAM 44. The printer 1 of the illustrative embodiment is allowed to perform an arbitrarily-selected one of a plurality of previously-prepared resuming processes (e.g., below-mentioned first to third resuming processes) after executing the re-printing preparation. In the flash memory 45, stored is a resuming process specified as a target process to be executed from among the plurality of resuming processes.

After S37, the CPU 41 refers to information stored in the flash memory 45, and determines whether a first resuming process is specified as a target process to be executed (S39). The first resuming process is a process to restart printing from the head line of the print-interrupted page and cut the uncut position of the tape 8. When determining that the first resuming process is specified (S39: Yes), the CPU 41 determines whether there is an uncut position, based on the print interruption information stored in the RAM 44 (S41).

When determining that there is an uncut position (S41: Yes), the CPU 41 determines whether a margin width of the uncut page is equal to or more than a threshold value (S43). Specifically, when a margin width L2 of a frame-shaped margin area 102 (see FIGS. 11A and 11B) is equal to or more than a threshold value (e.g., 5 mm), the CPU 41 determines that the margin width of the uncut page is equal to or more than a threshold value (S43: Yes). In this case, the CPU 41 determines whether cutting before interruption is half cutting of a special page image (S45). The "cutting before interruption" is the last cutting performed before the interruption of the printed matter producing process. When determining that the cutting before interruption is not half cutting of a special page image (S45: No), the CPU 41 resets the uncut position as a cut target position in the cut-setting area of the RAM 44 (S47). The CPU 41 corrects the cut target position stored in the cut-setting area, based on a correction table 100 (see FIG. 7) (S49).

As shown in FIG. 7, on the correction table 100, conveyance speeds just before interruption and correction amounts for the cut target position are associated with each other. Each correction amount for the cut target position represents a distance by which the cut target position is corrected to be shifted downstream in the conveyance direction. In the illustrative embodiment, the correction amount for the cut target position is expressed in dots. In S49, a conveyance speed just before interruption is specified based on the print interruption information stored in the RAM 44. Then, a correction amount for the cut target position corresponding to the specified conveyance speed just before interruption is specified with reference to the correction table 100. Each of all cut target positions stored in the cut-setting area is corrected to be shifted downstream in the conveyance direction by the specified correction amount for the cut target position.

After S49, the CPU 41 sets information for restarting printing from the print-interrupted page (S51). Specifically, based on the print interruption information stored in the RAM 44, the CPU 41 resets the print information of the print-interrupted page as a processing target, and resets cut target positions of the print-interrupted page in the cut-setting area. The cut target positions of the print-interrupted page set at this time are the head line and the bottom line of the print-interrupted page to be re-printed.

After S51, the CPU 41 goes back to S3. Thereby, in the following processes, the CPU 41 resumes printing from the head line of the print-interrupted page, based on the reset print information of the print-interrupted page (S3 and S5). Further, when the corrected uncut position reaches the cutter position T2, the cutter position T2 is determined to be coincident with the cut target position in the conveyance direction, and the tape 8 is cut in the corrected uncut position (S11: Yes, and S23).

When determining that the first resuming process is not specified as a target process to be executed (S39: No), the CPU 41 determines whether a second resuming process is specified as a target process to be executed, with reference to the information stored in the flash memory 45 (S53). The second resuming process is a process to restart printing from the head line of the print-interrupted page without cutting the uncut position of the tape 8. When determining that the second resuming process is specified as a target process to be executed (S53: Yes), the CPU 41 goes to S51. Thereby, in the following processes, based on the print information of the print-interrupted page, the CPU 41 resumes printing from the head line of the print-interrupted page (S3 and S5), and does not perform cut control (S23) based on the uncut position.

When determining that the second resuming process is not specified as a target process to be executed (S53: No), the CPU 41 determines that a third resuming process is specified as a target process to be executed. The third resuming process is a process to restart printing from the head line of the uncut page without cutting the uncut position of the tape 8. In this case, the CPU 41 sets information for resuming printing from the uncut page (S55). Specifically, based on the print interruption information stored in the RAM 44, the CPU 41 resets the print information of the uncut page as a processing target, and resets cut target positions of the uncut page in the cut-setting area of the RAM 44. The cut target positions of the uncut page set at this time are the head line and the bottom line of the print-interrupted page to be re-printed.

After S55, the CPU 41 goes back to S3. Thereby, in the following processes, based on the print information of the uncut page, the CPU 41 resumes printing from the head line of the uncut page (S3 and S5), and does not perform cut control (S23) based on the uncut position. In this case, after printing of the uncut page is completed, the print-interrupted page is re-printed from the head line thereof.

Referring to FIGS. 8A to 13C, a specific explanation will be provided of the printed matter producing process based on the aforementioned main process. In examples shown in FIGS. 8A to 9C, four labels 8A with respective page images P1 to P4 printed thereon are produced, and are individually separated by half cutting. The page image P1 corresponding to a top page shows "ABC." The subsequent page images P2, P3, and P4 show "123," "DEF," and "456," respectively.

When the main process is started, the pre-printing process is first performed, in which the print information of the page image P1 is set as a processing target (S1). The page image P1 "ABC" is printed on the tape 8 being conveyed in the head position T1 (S3, S5, and S13). When the printing of the page image P1 is completed, the print information of the page image P2 is set as a processing target (S9: Yes, S19: No, and S21). As shown in FIG. 8A, the page image P2 "123" is printed on the tape 8 being conveyed in the head position T1 (S5 and S13).

When the printing of the page image P2 is completed, the print information of the page image P3 is set as a processing target (S9: Yes, S19: No, and S21). As shown in FIG. 8B, the page image P3 "DEF" is printed on the tape 8 being conveyed in the head position T1 (S5 and S13). While the page image P3 is being printed, the head line of the page image P1 reaches the cutter position T2, and the tape 8 is half-cut (S11: Yes, and S23).

As shown in FIG. 8C, after the tape 8 is half-cut in the head line of the page image P1, while printing of the page image P3 is continuously performed, for instance, an electric power outage occurs, and the printed matter producing process is interrupted (S7: Yes, S15: Yes, and S17). At this time, print interruption information is saved that includes the print information of the page images P1 and P2 as uncut pages, the print information of the page image P3 as a print-interrupted page, and a conveyance speed just before the interruption. In this case, uncut positions are the bottom line of the page image P1 and the bottom line of the page image P2.

Afterward, when the printer 1 is recovered from the electric power outage by a user operation, the re-printing preparation for the printer 1 is performed (S33: Yes, and S37). In this example, the first resuming process is specified in the flash memory 45 (S39: Yes). Each of the page images P1 to P4 is a normal page image having a margin width equal to or more than the threshold value (S43: Yes) and a page length equal to or more than the lower limit (S45: No). Accordingly, the bottom line of the page image P1 and the bottom line of the page image P2 are reset as cut target positions in the cut-setting area of the RAM 44 (S47), and are corrected based on the correction table 100 (see FIG. 7) (S49). Further, the print information of the page image P3 is reset as a processing target (S51). At this time, the head line and the bottom line of the page image P3 to be re-printed are reset as cut target positions in the cut-setting area.

As shown in FIG. 9A, when the printed matter producing process is resumed, printing is restarted from the head line of the page image P3, and "DEF" as a specific image of the page image P3 is re-printed on the tape 8 being conveyed (S3, S5, and S13). While the page image P3 is being re-printed, the bottom line of the page image P1 reaches the cutter position T2, and the tape 8 is half-cut (S11: Yes, and S23). Thereby, a label 8A with the page image P1 printed thereon is produced.

When the re-printing of the page image P3 is completed, the print information of the page image P4 is set as a processing target (S9: Yes, S19: No, and S21). As shown in FIG. 9B, "456" as a specific image of the page image P4 is printed on the tape 8 being conveyed in the head position T1 (S5 and S13). While the page image P4 is being printed, the bottom line of the page image P2 reaches the cutter position T2, and the tape 8 is half-cut (S11: Yes, and S23). Thereby, a label 8A with the page image P2 printed thereon is produced.

As shown in FIG. 9C, after the printing of the page image P4 is completed, the head line of the re-printed page image P3 reaches the cutter position T2, and the tape 8 is half-cut (S11: Yes, and S23). Thereby, an unnecessary label 8B on which the print-interrupted page image P3 has been printed is produced. The user may discard the unnecessary label 8B. Thereafter, the bottom line of the re-printed page image P3 reaches the cutter position T2, and the tape 8 is half-cut. Thereby, a label 8A with the page image P3 re-printed thereon is produced. Finally, the bottom line of the page image P4, which is the final page, reaches the cutter position T2, and the tape 8 is full-cut. Thereby, a label 8A with the page image P4 printed thereon is produced.

Figure 10A:
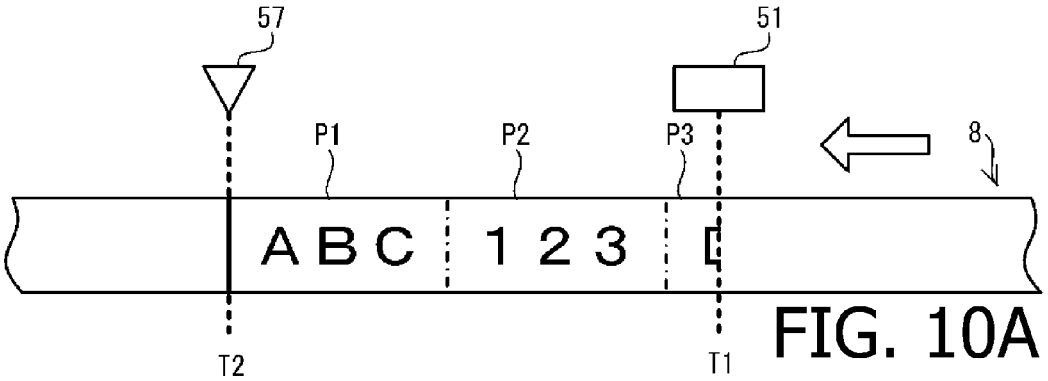

Referring to FIGS. 10A to 10D, an explanation will be provided of operations to correct the cut target position based on the correction table 100. As shown in FIG. 10A, in the same manner as exemplified in FIG. 8B, the page images P1 to P3 are sequentially printed on the tape 8 in a printed matter producing process. While the page image P3 is being printed, the head line of the page image P1 reaches the cutter position T2, and the tape 8 is half-cut. Afterward, in the same manner as exemplified in FIG. 8C, for instance, the printed matter producing process is interrupted due to an electric power outage.

Figure 10B:
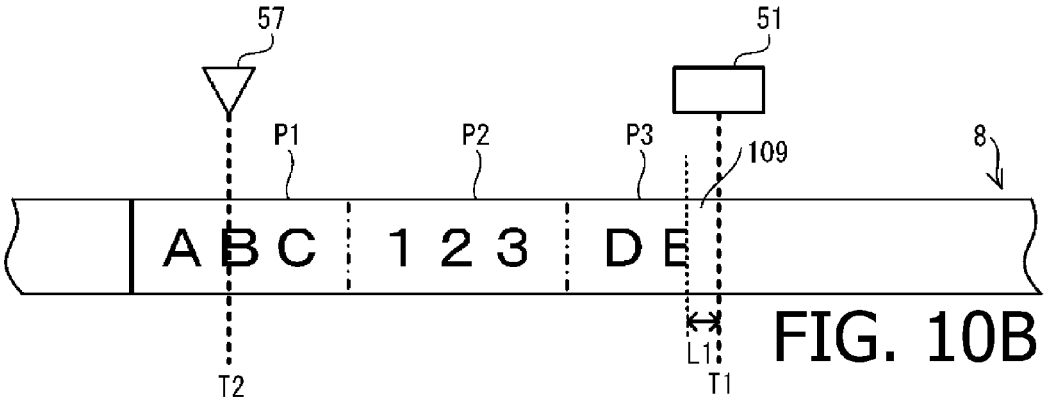
Figure 10C:
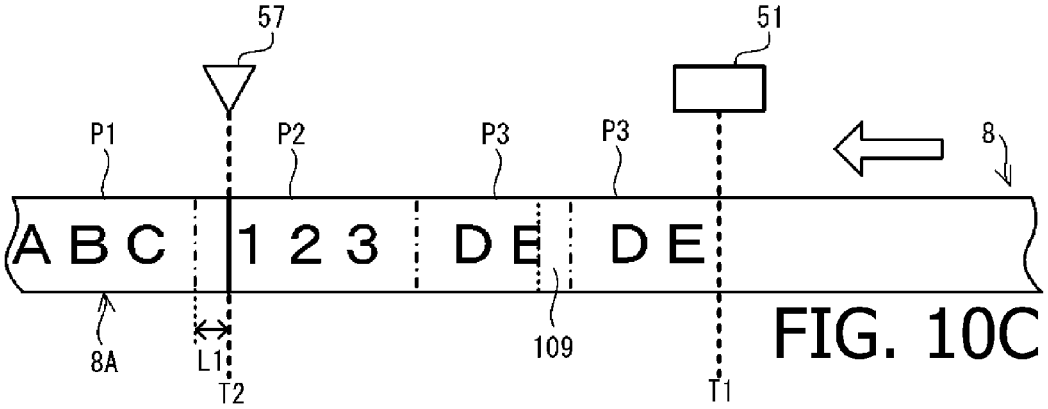
Figure 10D:
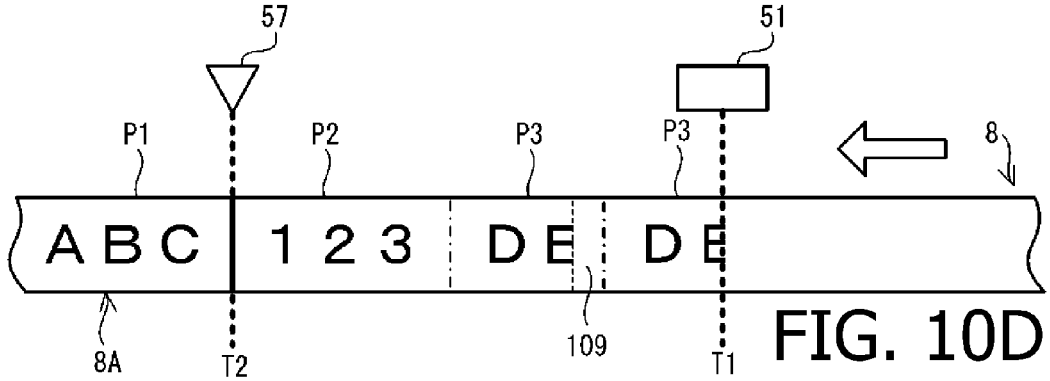

At this time, as shown in FIG. 10B, when conveyance of the tape 8 and printing are stopped, the tape 8 may slightly move downstream in the conveyance direction by an inertia force. In such a case, a blank area 109 is formed between the bottom line of the print-interrupted page image P3 and the head position T1. The blank area 109 is an area where printing is not performed on the tape 8. A length of the blank area 109 in the conveyance direction is equal to the distance L1 by which the tape 8 has moved due to the inertia force.

In this case, when the printed matter producing process is resumed without correction of the uncut position, the tape 8 is cut in an uncorrected uncut position that is located the distance L1 upstream of the bottom line of the uncut page in the conveyance direction. In an example shown in FIG. 10C, when the printed matter producing process is resumed without correction of the uncut position, the tape 8 is half-cut in an uncorrected uncut position that is located the distance L1 upstream of the bottom line of the page image P1 (i.e., the uncut page) in the conveyance direction. Namely, the tape 8 is half-cut in a position displaced from the bottom line of the page image P1, within the area of the page image P2.

In the illustrative embodiment, on the correction table 100, a correction amount for the cut target position corresponding to the distance L1 by which the tape 8 has moved due to the inertia force is defined in association with the conveyance speed just before the interruption. In S49 of the main process, before the printed matter producing process is resumed, the uncut position is corrected to a downstream position in the conveyance direction based on the correction amount for the cut target position corresponding to the conveyance speed just before the interruption. Accordingly, in an example shown in FIG. 10D, as a result when the printed matter producing process is resumed after correction of the uncut position, the tape 8 is half-cut in a position substantially coincident with the bottom line of the page image P1 as the uncut page.

Referring to FIGS. 11A and 11B, an explanation will be provided of operations to cut the tape 8 when the margin width of the uncut page is equal to or more than the threshold value. As described above, there may be a case where the blank area 109 is formed on the tape 8 by an inertia force when the printed matter producing process is interrupted. In examples shown in FIGS. 11A and 11B, as the printed matter producing process is interrupted while the page image P3 is being printed, the blank area 109 is formed at a bottom portion of the page image P3 as a print-interrupted page. The tape 8 is half-cut in a position that is located the distance L1 upstream of the bottom line of the page image P1 as an uncut page. In the examples shown in FIGS. 11A and 11B, on each of the page images P1 to P3, a boundary line between the image area 101 and the margin area 102 is printed.

The less the margin width L2 of the margin area 102 is, the higher the possibility is that the image area 101 of a page image might be cut when an actual cut position is displaced from the cut target position as described above. In other words, when the margin width L2 of the margin area 102 is relatively narrow, the possibility is relatively high that the image area 101 of a page image might be cut when an actual cut position is displaced from the cut target position. In the example shown in FIG. 11A, the margin width L2 of the margin area 102 is less than the threshold value and is relatively narrow. In this example, the tape 8, which should be cut in the bottom line of the page image P1, is cut in a position within the image area 101 of the page image P2 in the conveyance direction since an actual cut position is displaced from the bottom line of the page image P1.

Meanwhile, when the margin width L2 of the margin area 102 is relatively large, even if an actual cut position is displaced from the target cut position as described above, the possibility that the image area 101 of a page image might be cut is relatively low. In the example shown in FIG. 11B, the margin width L2 of the margin area 102 is equal to or more than the threshold value and is relatively large. In this example, the tape 8, which should be cut in the bottom line of the page image P1, is cut in a position within the margin area 102 between the bottom line of the page image P1 and the image area 101 of the page image P2 in the conveyance direction since an actual cut position is displaced from the bottom line of the page image P1. Thus, in this example, even though the actual cut position is displaced from the cut target position, it is possible to prevent the image area 101 from being cut.

Referring to FIGS. 12A to 13C, an explanation will be provided of operations of, when the cutting before interruption is half cutting of a special page image, not performing the half cutting. In example shown in FIGS. 12A to 13C, three labels with the page images P1 to P3 respectively printed thereon are produced. Each of the page images P1 and P3 is a normal page image having a page length equal to or more than the lower limit. The page image P2 is a special page image having a page length less than the lower limit.

Referring to FIGS. 12A to 12C, an explanation will be provided of a process to be performed when the printed matter producing process is not interrupted. As exemplified in FIG. 12A, the page images P1 to P3 are sequentially printed in the printed matter producing process (S3, S5, and S13). When the bottom line of the page image P1 reaches the cutter position T2, the bottom line of the page image P1 (i.e., the head line of the page image P2) is full-cut (S23). Thereby, a label 8A with the page image P1 printed thereon is produced.

Subsequently, as shown in FIG. 12B, the bottom line of the page image P2 reaches the cutter position T2 while the page image P3 is being printed, and the tape 8 is half-cut in the bottom line of the page image P2 (S23). Then, as shown in FIG. 12C, after the page image P3 is printed, the margin-added line of the page image P2 reaches the cutter position T2, and the tape 8 is full-cut in the margin-added line of the page image P3. Thereby, a label 8A with the page image P3 printed thereon is produced.

On the special label 8C, the page section 103 and the margin section 104 are disposed adjacent to each other across a slit formed therebetween by half cutting. The page section 103 is a portion on which the page image P2 is printed. The margin section 104 is positioned upstream of the page section 103 in the conveyance direction. The margin section 104 is a portion added to make a length of the special label 8C in the conveyance direction equal to the lower limit. The user is allowed to use a particular portion, on which the page section 103 is formed, of the release paper of the special label 8C after peeling only the particular portion away from the mount by using the slit.

Suppose, for instance, that a label is produced by full-cutting both ends of a special page image on the tape 8 in the conveyance direction. In such a case, a length of the produced label in the conveyance direction is small. Therefore, there is a possibility that the label might not be discharged out of the conveyance guide 23 (see FIG. 2). Meanwhile, the length of the special label 8C in the conveyance direction is equal to the lower limit. Thus, the special label 8C has a length in the conveyance direction that is required to be certainly discharged out of the conveyance guide 23.

Referring to FIGS. 13A to 13C, an explanation will be provided of a process to be performed when the printed matter producing process is interrupted. Firstly, in the same manner as exemplified in FIGS. 12A and 12B, the label 8A with the page image P1 printed thereon is produced, and the bottom line of the page image P2 is half-cut. Subsequently, as exemplified in FIG. 13A, for instance, an electric power outage occurs while the page image P3 is being printed, and the printed matter producing process is interrupted (S7: Yes, S15: Yes, and S17). At this time, print interruption information is saved that includes the print information of the page image P2 as an uncut page, the print information of the page image P3 as a print-interrupted page, and a conveyance speed just before the interruption. In this case, the margin-added line of the page image P2 is an uncut position.

After that, for instance, when the printer 1 is recovered from the electric power outage by a user operation, the re-printing preparation for the printer 1 is performed (S33: Yes, and S37). In this example, the first resuming process is specified in the flash memory 45 (S39: Yes). The cutting before interruption is half cutting of the page image P2 as a special page image (S45: Yes). Therefore, the margin-added line of the page image P2 is not reset in the cut-setting area of the RAM 44. Thereafter, the print information of the page image P3 is reset as a processing target (S51).

As shown in FIG. 13B, when the printed matter producing process is resumed, printing is restarted from the head line of the page image P3, and the page image P3 is reprinted from the headline thereof on the tape 8 being conveyed (S3, S5, and S13). Even though the margin-added line of the page image P2 reaches the cutter position T2 during the printing of the page image P3, the printing of the page image P3 is continued without the tape 8 being cut in the margin-added line of the page image P2.

As shown in FIG. 13C, after the reprinting of the page image P3 is completed, the head line of the reprinted page image P3 reaches the cutter position T2, and the tape 8 is full-cut (S11: Yes, and S23). Thereby, a special label 8C with the page image P2 printed thereon is produced. Afterward, the bottom line of the reprinted page image P3 is full-cut, and a label 8A with the page image P3 printed thereon is produced.

On the special label 8C, the page section 103, the margin section 104, and a discarded section 105 are arranged. In the page section 103, the page image P2 is printed. The margin section 104 is positioned upstream of the page section 103 in the conveyance direction. The discarded section 105 is positioned upstream of the margin section 104 in the conveyance direction. In the discarded section 105, only a part of the page image P3 is printed because of the interrupted printing of the page image P3. The page section 103 and the margin section 104 are disposed adjacent to each other across a slit formed therebetween by half cutting. The margin section 104 is continuous with the discarded section 105.

The user is allowed to use a particular portion, on which the page section 103 is formed, of the release paper of the special label 8C after peeling only the particular portion away from the mount by using the slit. The user may discard the special label 8C with the margin section 104 and the discarded section 105 remaining, after peeling the particular portion on which the page section 103 is formed away from the special label 8C. In this example, the tape 8 is not cut in the boundary between the two sections 104 and 105 to be discarded. Thereby, it is possible to reduce the number of cuttings in the printed matter producing process and expedite the printed matter producing process.

As described above, the printer 1 of the illustrative embodiment includes the conveyance motor 88, the RAM 44, the print head 51, the cutter 57, and the CPU 41. The conveyance motor 88 is configured to convey the tape 8 as a long strip-shaped print medium along the conveyance path. The print head 51 is configured to sequentially print a plurality of page images on the tape 8 being conveyed, in the head position T1 on the conveyance path. Each page image is an image representing a single unit of page. The cutter 57 is configured to cut the tape 8 in the cutter position T2. The cutter position T2 is located downstream of the head position T1 in the conveyance direction of the tape 8. The RAM 44 is configured to store print data for printing the plurality of page images. The RAM 44 is further configured to store cut target positions of the tape 8 to be cut by the cutter 57.

The CPU 41 is configured to perform the printed matter producing process including the following steps. Specifically, the CPU 41 controls the print head 51 to sequentially print the page images on the tape 8 on the basis of the print data stored in the RAM 44 while controlling the conveyance motor 88 to convey the tape 8 (S5 and S13). The CPU 41 stores into the RAM 44 a cut target position for a page image printed on the tape 8 (S21). When the cut target position stored in the RAM 44 reaches the cutter position T2, the CPU 41 controls the cutter 57 to cut the tape 8 (S23).

When an error occurs while the printed matter producing process is being performed, the CPU 41 interrupts the printed matter producing process, and stores uncut positions into the RAM 44 (S17). The uncut positions are cut target positions between the head position T1 and the cutter position T2. When the error is settled during the interruption of the printed matter producing process, the CPU 41 resumes the printed matter producing process, and executes the step S23 based on the uncut positions stored in S17 (S47).

According to the illustrative embodiment, after an error occurs during the execution of the printed matter producing process, when the error is solved during the interruption of the printed matter producing process, the printed matter producing process is resumed. At this time, the tape 8 is cut in the uncut positions that are left uncut because of the interruption of the printed matter producing process. Accordingly, even though an error occurs while a page image is being printed, the printer 1 is allowed to appropriately cut the tape 8 with the page image printed thereon.

Further, the CPU 41 stores, into the RAM 44, print data corresponding to the whole of a print-interrupted page of the plurality of page images (S17). The print-interrupted page is a page image only a part of which is printed as the printed matter producing process is interrupted while the page image is being printed. The CPU 41 executes the steps S5 and S13 to restart the printing of the print-interrupted page from the head line of the print-interrupted page on the basis of the print data stored in S17 (S51). Thereby, the printer 1 is allowed to reprint the print-interrupted page on the tape 8 in the resumed printed matter producing process.

Further, the CPU 41 stores into the RAM 44 a conveyance speed of the tape 8 immediately before the printed matter producing process is interrupted (S17). The CPU 41 corrects the uncut positions stored in S17 to be shifted downstream in the conveyance direction in accordance with the conveyance speed stored in S17 (S49). Thereby, the printer 1 is allowed to correct the uncut positions to proper positions in view of a movement of the tape 8 by an inertia force generated when the printed matter producing process is interrupted.

Further, each page image includes the image area 101 in which one or more characters are printed, and the margin area 102 provided around the image area 101. When the margin width L2 of the margin area 102 included in the page image corresponding to an uncut position stored in S17 is less than the threshold value (S43: No), the CPU 41 does not execute the step S23 based on the uncut position. Thereby, it is possible to prevent the image area 101 from being cut in the resumed printed matter producing process.

Further, the CPU 41 stores the cutting type for a cut target position into the RAM 44 (S21). It is noted that the cutting type indicates one of full cutting to fully cut the tape 8 in a thickness direction of the tape 8 and half cutting to partially cut the tape 8 in the thickness direction. When cutting the cut target position of the tape 8 in the cutter position T2, the CPU 41 performs one of full cutting and half cutting based on the cutting type stored in the RAM 44 in association with the cut target position (S23). Thereby, the printer 1 is allowed to cut a cut target position of the tape 8 in accordance with a cutting type suitable for, e.g., the intended use of a label obtained after the cutting.

Further, when the cutting type for the uncut position stored in S17 is full cutting, and half cutting was performed in the last-executed S23 before the interruption of the printed matter producing process, the CPU 41 does not perform cut control in S23 based on the uncut position (S45: Yes). Thereby, in the presumed printed matter producing process, the printer 1 is allowed to omit full cutting of the uncut position.

Further, when the error is settled during the interruption of the printed matter producing process, the CPU 41 is allowed to perform a process specified from among at least two of the first resuming process (S41 to S51), the second resuming process (S51), and the third resuming process (S55). In the second resuming process, the CPU 41 starts S3 and S5 to resume the printed matter producing process such that printing is restarted from the head line of the print-interrupted page. In the third resuming process, the CPU 41 starts S3 and S5 to resume the printed matter producing process such that printing is restarted from the head line of the uncut page corresponding to the uncut position among the plurality of page images. Thereby, the printer 1 is allowed to resume the printed matter producing process in a manner according to a user's request.

Further, the CPU 41 executes S17 when the electric power supplied to the printer 1 changes to less than the reference value from equal to or more than the reference value during the execution of the printed matter producing process (S7: Yes, and S15: Yes). The CPU 41 performs the first resuming process (S41 to S51) when the electric power supplied to the printer 1 changes from less than the reference value to equal to or more than the reference value during the interruption of the printed matter producing process (S33: Yes). Thereby, the printer 1 is allowed to interrupt or resume the printed matter producing process depending on (a change in) the electric power supplied to the printer 1.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

The printer 1 may include a display such as a liquid crystal display. In this case, in S37, the CPU 41 may display on the display a selection screen for selecting thereon a resuming process from among at least two of the first to third resuming processes. Then, in S39 and the following steps, the CPU 41 may perform one of the first to third resuming processes based on the resuming process selected on the selection screen.

Further, if the margin width of the uncut page is less than the threshold value when the CPU 41 performs the first resuming process (S41 to S51), the CPU 41 may display a warning screen on the display before executing S41. The warning display may provide a warning that the tape 8 might not accurately be cut in the cut target position since the tape 8 might have moved due to the inertial force applied to the tape 8. Additionally, the warning screen may prompt the user to make a selection as to whether there is a need to cut the uncut position of the tape 8. For instance, the CPU 41 may execute S41 when the user issues an instruction to cut the uncut position of the tape 8 via the warning screen. Meanwhile, when the user does not issue an instruction to cut the uncut position of the tape 8 via the warning screen, the CPU 41 may the second resuming process (S51) or the third resuming process (S55) instead of the first resuming process.

Further, the main process may be applied when a printed matter such as a label is produced not only with the tape 8 or the tube 9 but also with other print media. At least a part of the main process may be performed by a device (e.g., the PC 2) different from the printer 1. The print data stored in the receive buffer 44A is not limited to print data transmitted by the PC 2. A part (e.g., at least one of the steps S43, S45, and S49) of the main process may not be performed. The print data stored in the receive buffer 44A may be print data received from an external device via a network, or print data directly input into the printer 1 by the user.

What is claimed is:

1. A printer comprising:

a conveyor configured to convey a print medium in a conveyance direction along a conveyance path;

a print head configured to sequentially print a plurality of page images on the print medium in a first position on the conveyance path, each page image being an image representing a single unit of page;

a cutter configured to cut the print medium in a second position on the conveyance path, the second position being downstream of the first position in the conveyance direction;

a first storage configured to store print data for printing each of the plurality of page images;

a second storage configured to store a cut target position of the print medium to be cut by the cutter; and a controller configured to execute:

a printed matter producing process comprising:

controlling the print head to sequentially print the plurality of page images on the print medium based on the print data stored in the first storage, while controlling the conveyor to convey the print medium;

storing into the second storage a cut target position for each of the page images printed on the print medium; and when the cut target position stored in the second storage reaches the second position, controlling the cutter to cut the print medium;

an interrupting process comprising:

when an error occurs during the execution of the printed matter producing process, interrupting the printed matter producing process, and storing an uncut position of the print medium into a particular storage, the uncut position being a cut target position located between the first position and the second position when the printed matter producing process is interrupted; and a first resuming process comprising:

when the error is settled during the interruption of the printed matter producing process, resuming the printed matter producing process, and controlling the cutter to cut the print medium when the uncut position stored in the interrupting process reaches the second position.

2. The printer according to claim 1, wherein the interrupting process further comprises storing specific print data for an entire print-interrupted page into the particular storage, the print-interrupted page being such a specific page image that the printed matter producing process is interrupted while the specific page image of the plurality of page images is being printed, and wherein the first resuming process further comprises resuming the printed matter producing process such that printing is restarted from a head of the print-interrupted page based on the specific print data stored in the interrupting process.

3. The printer according to claim 1, wherein the interrupting process further comprises storing a specific conveyance speed into a particular storage, the specific conveyance speed being a conveyance speed of the print medium immediately before the interruption of the printed matter producing process, and wherein the first resuming process further comprises:

correcting the uncut position stored in the interrupting process to be shifted downstream in the conveyance direction based on the specific conveyance speed stored in the interrupting process; and controlling the cutter to cut the print medium when the corrected uncut position reaches the second position.

4. The printer according to claim 1, wherein each page image comprises:

an image area in which one or more characters are printed; and a margin area provided around the image area, and wherein the first resuming process further comprises:

when a margin width of the margin area included in an uncut page in the conveyance direction is less than a threshold value, controlling the cutter not to cut the print medium based on the uncut position stored in the interrupting process, the uncut page being era page image corresponding to the uncut position stored in the interrupting process, of the plurality of page images.

5. The printer according to claim 1, wherein the printed matter producing process further comprises:

storing a cutting type into the second storage in association with the cut target position, the cutting type indicating one of:

first cutting to fully cut the print medium in a thickness direction of the print medium; and second cutting to partially cut the print medium in the thickness direction of the print medium; and when the cut target position stored in the second storage reaches the second position, controlling the cutter to cut the print medium in accordance with the cutting type associated with the cut target position.

6. The printer according to claim 5, wherein the first resuming process further comprises:

when the cutting type associated with the uncut position stored in the interrupting process is the first cutting, and the second cutting was performed in a last-executed cutting operation before the interruption of the printed matter producing process, controlling the cutter not to cut the print medium based on the uncut position stored in the interrupting process.

7. The printer according to claim 2, wherein the controller is further configured to, when the error is settled during the interruption of the printed matter producing process, execute a process specified from among at least two of the first resuming process, a second resuming process, and a third resuming process, wherein the second resuming process comprises resuming the printed matter producing process such that printing is restarted from the head of the print-interrupted page without controlling the cutter to cut the print medium based on the uncut position, and wherein the third resuming process comprises resuming the printed matter producing process such that printing is restarted from a head of an uncut page, the uncut page being a page image corresponding to the uncut position, of the plurality of page images.

8. The printer according to claim 1, wherein the controller is further configured to:

execute the interrupting process when an electric power supplied to the printer changes to less than a reference value from equal to or more than the reference value during the execution of the printed matter producing process; and execute the first resuming process when the electric power supplied to the printer changes to equal to or more than the reference value from less than the reference value during the interruption of the printed matter producing process.

9. The printer according to claim 1, wherein the controller comprises:

a processor; and a memory storing processor-executable instructions configured to, when executed by the processor, cause the processor to execute the printed matter producing process, the interrupting process, and the first resuming process.

10. A method adapted to be implemented on a processor coupled with a printer comprising a conveyor, a print head, a cutter, a first storage, and a second storage, the method comprising:

a printed matter producing process comprising:

while controlling the conveyor to convey a print medium along a conveyance path in a conveyance direction, controlling the print head to sequentially print a plurality of page images on the print medium in a first position on the conveyance path, based on print data stored in the first storage;

storing into the second storage a cut target position for each of the page images printed on the print medium, the cut target position being a position of the print medium to be cut by the cutter; and when the cut target position stored in the second storage reaches a second position on the conveyance path, controlling the cutter to cut the print medium in the second position, the second position being downstream of the first position in the conveyance direction;

an interrupting process comprising:

when an error occurs during the execution of the printed matter producing process, interrupting the printed matter producing process, and storing an uncut position of the print medium into a particular storage, the uncut position being a cut target position located between the first position and the second position when the printed matter producing process is interrupted; and a resuming process comprising:

when the error is settled during the interruption of the printed matter producing process, resuming the printed matter producing process, and controlling the cutter to cut the print medium when the uncut position stored in the interrupting process reaches the second position.

11. A non-transitory computer-readable medium storing computer-readable instructions that are executable by a processor coupled with a printer comprising a conveyor, a print head, a cutter, a first storage, and a second storage, the instructions being configured to, when executed by the processor, cause the processor to execute:

a printed matter producing process comprising:

while controlling the conveyor to convey a print medium along a conveyance path in a conveyance direction, controlling the print head to sequentially print a plurality of page images on the print medium in a first position on the conveyance path, based on print data stored in the first storage;

storing into the second storage a cut target position for each of the page images printed on the print medium, the cut target position being a position of the print medium to be cut by the cutter; and when the cut target position stored in the second storage reaches a second position on the conveyance path, controlling the cutter to cut the print medium in the second position, the second position being downstream of the first position in the conveyance direction;

an interrupting process comprising:

when an error occurs during the execution of the printed matter producing process, interrupting the printed matter producing process, and storing an uncut position of the print medium into a particular storage, the uncut position being a cut target position located between the first position and the second position when the printed matter producing process is interrupted; and a resuming process comprising:

when the error is settled during the interruption of the printed matter producing process, resuming the printed matter producing process, and controlling the cutter to cut the print medium when the uncut position stored in the interrupting process reaches the second position.

* * * * *